US009740121B2

(12) United States Patent
Hoshino

(10) Patent No.: US 9,740,121 B2
(45) Date of Patent: Aug. 22, 2017

(54) IMAGE FORMING APPARATUS

(71) Applicant: Oki Data Corporation, Tokyo (JP)

(72) Inventor: Masahiko Hoshino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/270,709

(22) Filed: Sep. 20, 2016

(65) Prior Publication Data

US 2017/0090313 A1 Mar. 30, 2017

(30) Foreign Application Priority Data

Sep. 24, 2015 (JP) ..... 2015-186862

(51) Int. Cl.
*G03G 15/20* (2006.01)
*G03G 9/08* (2006.01)

(52) U.S. Cl.
CPC ..... *G03G 9/0819* (2013.01); *G03G 15/20* (2013.01)

(58) Field of Classification Search
CPC ... G03G 9/0819; G03G 15/20; G03G 15/2078
See application file for complete search history.

(56) References Cited

U.S. PATENT DOCUMENTS 8,089,658 B2 * 1/2012 Maeyama ..... G03G 15/0121 358/1.9
2012/0107002 A1 * 5/2012 Nakayama ..... G03G 15/2046 399/69

FOREIGN PATENT DOCUMENTS

JP 2006-078545 A 3/2006

* cited by examiner

*Primary Examiner* — Hoang Ngo
(74) *Attorney, Agent, or Firm* — Muncy, Geissler, Olds & Lowe, P.C.

(57) ABSTRACT

An image forming apparatus includes a first development part provided with an image forming developer containing image forming pigments and image forming macromolecular compound, a second development part provided with a bonding developer containing bonding macromolecular compound, a transfer part transferring the image forming developer to a surface of a medium, and a fuser part fusing the image forming developer to the medium. Wherein heating temperature T1 (° C.) for the image forming developer by the fuser part and heating temperature T2 (° C.) for the bonding developer by the fuser part satisfy a condition expressed by Eq. (1) below, and solubility parameter δ1 of the image forming macromolecular compound and solubility parameter δ2 of the bonding macromolecular compound satisfy a condition expressed by Eq. (2) below.

$$10° \text{ C.} \leq T1 - T2 \leq 30° \text{ C.} \quad (1)$$

$$5.9 \leq |\delta 1 - \delta 2| \leq 7.4 \quad (2)$$

10 Claims, 5 Drawing Sheets

IMAGE FORMING APPARATUS

CROSS REFERENCE TO RELATED APPLICATION(S)

This application claims priority under 35 USC 119 to Japanese Application No. 2015-186862 filed on Sep. 24, 2015, the entire contents which are incorporated herein by reference.

TECHNICAL FIELD

This invention relates to an image forming apparatus that forms an image on the surface of a medium using developers and also forms an image structure using the medium on which the image is formed.

BACKGROUND

Electrophotographic image forming apparatuses are widely prevalent. It is because high-quality images can be obtained within a short time in comparison with image forming apparatuses of other systems such as the inkjet system.

In an electrophotographic image forming apparatus, an image is formed on a medium such as paper using an image forming developer. In this image forming process, after the image forming developer adheres to an electrostatic latent image formed on the surface of a photosensitive drum, the image forming developer is transferred to the surface of the medium.

Concerning this electrophotographic image forming apparatus, various investigations have been made. Specifically, in order to form an image structure that can conceal internal information, a bonding developer is used together with the image forming developers (for example, see Patent Document 1).

In forming this image structure, after an image is formed on the surface of the medium using the image forming developers, the medium on which the image is already formed that is folded in two is bonded so as to conceal the internal information (image) using the bonding developer. In this image structure, because the bonded medium can be peeled off, the concealed internal information can be read as necessary.

PRIOR ART

Patent Document

[Patent Document 1] Japanese Unexamined Patent Application 2006-078545

As mentioned above, although forming an image structure using an electrophotographic image forming apparatus is being considered, the quality of the image structure cannot be regarded as sufficient yet, having some room for improvement.

This invention has been made considering such a problem, and its objective is to provide an image forming apparatus that can improve the quality of the image structure.

SUMMARY

An image forming apparatus disclosed in the application for forming an image developer image on a medium that is carried along a medium carrying route, include at least a first development part that is provided with an image forming developer containing image forming pigments and image forming macromolecular compound, supplying the image forming developer; at least a second development part that is provided with a bonding developer containing bonding macromolecular compound, supplying the bonding developer; a transfer part that transfers the image forming developer supplied from the first development part to a surface of a medium, and also transfers the bonding developer supplied from the second development part to the surface of the medium to which the image forming developer was transferred, and a fuser part that is positioned at a downstream side of the medium carrying route from the transfer part and fuses the image forming developer to the medium by heating the image forming developers transferred by the transfer part, and also fuses the bonding developer with the medium by heating the bonding developer transferred by the transfer part to the surface of the medium where the image forming developer is fused. Heating temperature T1 (° C.) for the image forming developer by the fuser part and heating temperature T2 (° C.) for the bonding developer by the fuser part satisfy a condition expressed by Eq. (1) below, and solubility parameter δ1 of the image forming macromolecular compound and solubility parameter δ2 of the bonding macromolecular compound satisfy a condition expressed by Eq. (2) below.

$$10^\circ\ \text{C.} \le T1 - T2 \le 30^\circ\ \text{C.} \quad (1)$$

$$5.9 \le |\delta 1 - \delta 2| \le 7.4 \quad (2)$$

An image forming apparatus disclosed in the application for forming an image developer image on a medium that is carried along a medium carrying route, includes: at least a first development part that is provided with an image forming developer containing image forming pigments and image forming macromolecular compound, supplying the image forming developer; at least a second development part that is provided with a bonding developer containing bonding macromolecular compound, supplying the bonding developer; a transfer part that transfers the image forming developer supplied from the first development part to a surface of a medium, and also transfers the bonding developer supplied from the second development part to the surface of the medium to which the image forming developer was transferred, and a fuser part that is positioned at a downstream side of the medium carrying route from the transfer part and fuses the image forming developer to the medium by heating the image forming developers transferred by the transfer part, and also fuses the bonding developer with the medium by heating the bonding developer transferred by the transfer part to the surface of the medium where the image forming developer is fused. Applied pressure P (kg/cm$^2$) for the bonding developer by the fuser part satisfies a condition expressed by Eq. (3) below, and solubility parameter δ1 of the image forming macromolecular compound and solubility parameter δ2 of the bonding macromolecular compound satisfy a condition expressed by Eq. (4) below.

$$1.5\ \text{kg/cm}^2 \le P \le 3.5\ \text{kg/cm}^2 \quad (3)$$

$$5.8 \le |\delta 1 - \delta 2| \le 7.5 \quad (4)$$

According to the image forming apparatus of an embodiment of this invention, heating temperatures T1 and T2 satisfy a condition shown in Eq. (1), and solubility parameters δ1 and δ2 satisfy a condition shown in Eq. (2), or an applied pressure P satisfies a condition shown in Eq. (3), and the solubility parameters δ1 and δ2 satisfy a condition shown in Eq. (4). Therefore, the quality of the image structure can be improved.

DETAILED DESCRIPTION OF THE EMBODIMENT(S)

Below, an embodiment of this invention is explained in detail referring to drawings. Note that the order of the explanations is as follows.

1. Configuration of the image forming apparatus
   1-1. Overall configuration
   1-2. Circuit configuration
   1-3. Configuration and physical properties of the developers
   1-4. Configuration of the image structure
2. Operations of the image forming apparatus
   2-1. Image forming process
   2-2. Bonding layer forming process
   2-3. Bonding process of the medium
3. Actions and effects of the image forming apparatus
4. Modifications <1. Configuration of the Image Forming Apparatus>

First, explanations are given on the configuration of the image forming apparatus of an embodiment of this invention.

<1-1. Overall Configuration>

Figure 1:
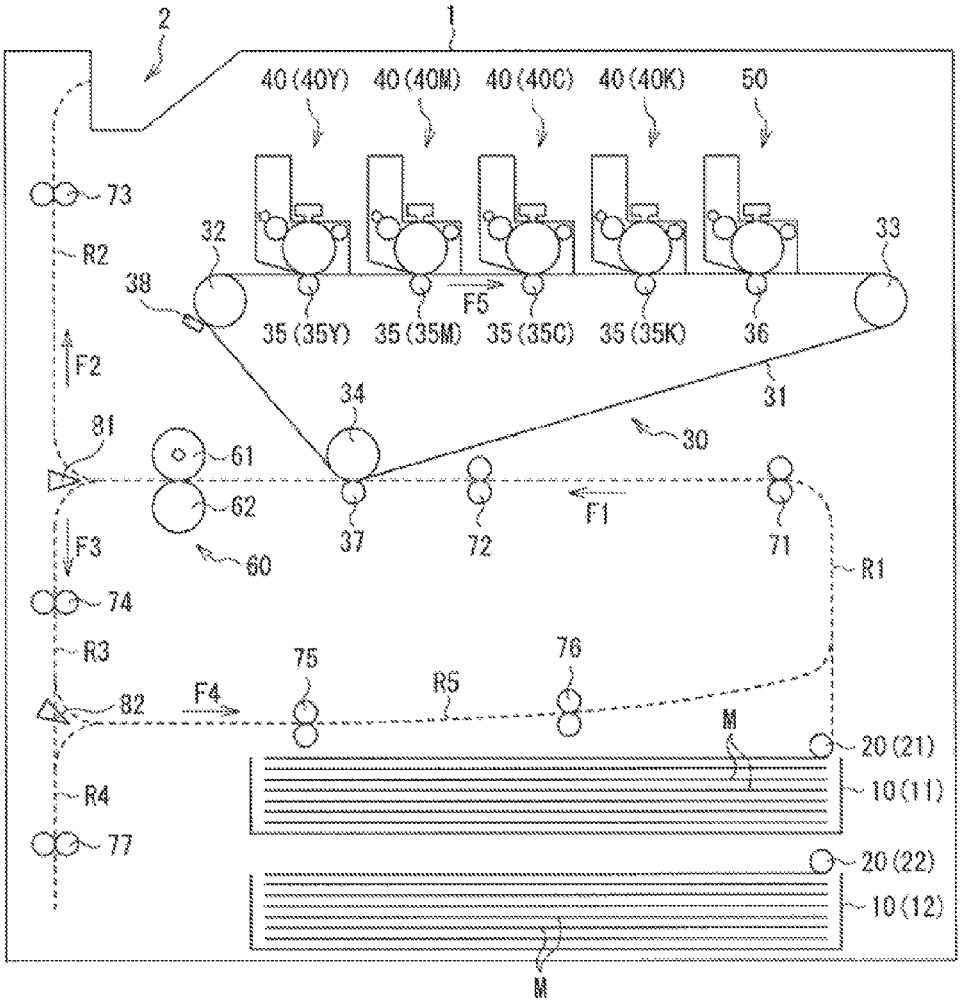
FIG. 1 is a diagram showing the configuration of an image forming apparatus of an embodiment of this invention.
Figure 2:
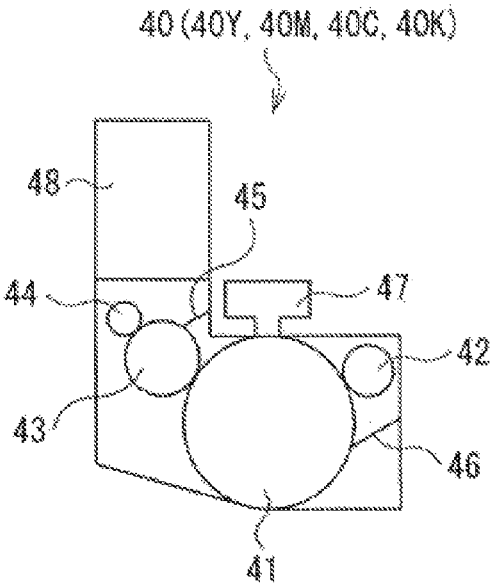
FIG. 2 is a diagram showing an enlarged view of the configuration of an image forming development part shown in FIG. 1.

FIG. 1 shows the configuration of the image forming apparatus. FIG. 2 shows an enlarged view of the configuration of the image forming development parts 40 shown in FIG. 1, and FIG. 3 shows an enlarged view of the configuration of the bonding development part 50 shown in FIG. 1.

The image forming apparatus explained here is an electrophotographic full-color printer. This image forming apparatus is used for forming an image on the surface of a medium M and afterwards forming an image structure S (see FIGS. 5-7 mentioned below) using the medium M on which the image is formed. Note that although the material of the medium M is not particularly limited, it is one or more types of paper, film, and the like for example.

Figure 3:
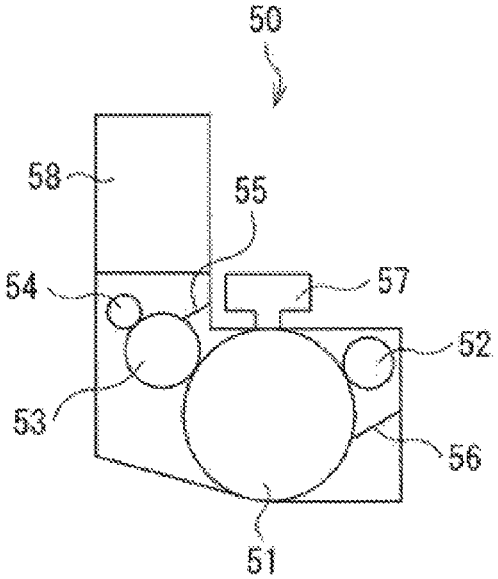
FIG. 3 is a diagram showing an enlarged view of the configuration of a bonding development part shown in FIG. 1.

As shown in FIGS. 1-3 for example, this image forming apparatus is provided, inside a chassis 1, with one or more trays 10, one or more forwarding rollers 20, a transfer part 30, one or more image forming development parts 40, one or more bonding development parts 50, a fuser part 60, carrying rollers 71-77, and carrying route switching guides 81 and 82. This chassis 1 is provided with a stacker part 2 for ejecting the medium M on which an image is formed. Note that broken lines R1-R5 indicate the carrying routes of the medium M.

[Tray and Forwarding Roller]

The tray 10 contains the medium M and is detachably attached to the chassis 1 for example. Inside this tray 10, for example, multiple pieces of medium M are contained in a stacked state, and those multiple pieces of medium M are taken out one by one from the tray 10 by the forwarding roller 20.

Here, the image forming apparatus is provided with, for example, two trays 10 (11 and 12) and two forwarding rollers 20 (21 and 22). Note that the tray 11 is disposed, for example, so as to overlie the tray 12.

[Transfer Part]

Figure 4:
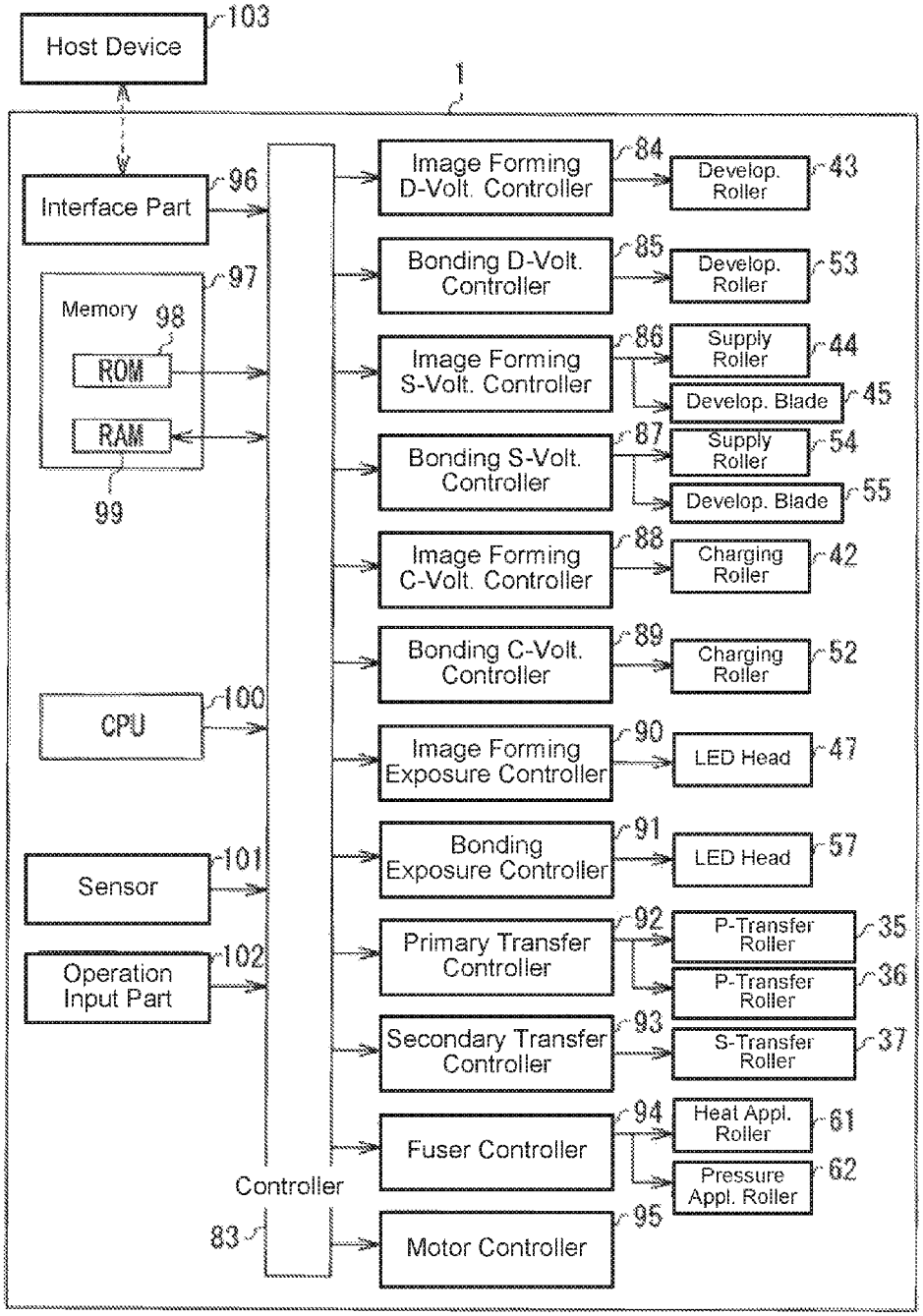
FIG. 4 is a diagram showing the circuit configuration of the image forming apparatus.

The transfer part 30 includes an intermediate transfer belt 31, a drive roller 32, a driven roller (idle roller) 33, a backup roller 34, one or more primary transfer rollers 35, one or more primary transfer rollers 36, a secondary transfer roller 37, and a cleaning blade 38. In FIG. 4, the primary transfer roller and the secondary transfer roller are respectively referred with P-transfer roller and S-transfer roller.

The intermediate transfer belt 31 is an intermediate transfer medium to which developers (or developer images) are temporarily transferred before the developers are transferred to the surface of the medium M. This intermediate transfer belt 31 is, for example, an endless elastic belt containing macromolecular compounds such as polyimide. Note that the intermediate transfer belt 31 can move clockwise according to the rotational force of the drive roller 32 in a state of being supported and stretched by the drive roller 32, the driven roller 33, and the backup roller 34.

Here, the developers are so-called toners, which include image forming developers supplied from the image forming development parts 40 and a bonding developer supplied from the bonding development part 50. Below, as necessary, the image forming developers and the bonding developer are called distinctively, or the image forming developers and the bonding developer are called collectively as developers. Note that the details of the image forming developers and the bonding developer are mentioned below.

Also, the developer images are so-called toner images, which include image forming developer images formed using the image forming developers and a bonding developer image formed using the bonding developer. Below, as necessary, the image forming developer images and the bonding developer image are called distinctively, or the image forming developer images and the bonding developer image are collectively called as developer images. Note that the details of the image forming developer images and the bonding developer image are mentioned below.

The drive roller 32 can rotate clockwise through a drive source such as a motor. Each of the driven roller 33 and the backup roller 34 can rotate clockwise in the same manner as the drive roller 32 according to the rotational force of the drive roller 32.

The primary transfer rollers 35 have image forming developers supplied from the image forming development parts 40 transferred (primary-transferred) to the intermediate transfer belt 31. This primary transfer rollers 35 are press-contacted by the image forming development parts 40 (below-mentioned photosensitive drums 41) through the intermediate transfer belt 31. Note that the primary transfer rollers 35 can rotate clockwise according to the movement of the intermediate transfer belt 31.

The primary transfer roller 36 has a bonding developer supplied from the bonding development part 50 transferred (primary-transferred) to the intermediate transfer belt 31. This primary transfer roller 36 is press-contacted by the bonding development part 50 (below-mentioned photosensitive drum 51) through the intermediate transfer belt 31. Note that the primary transfer roller 36 can rotate clockwise according to the movement of the intermediate transfer belt 31.

Here, for example, the transfer part 30 includes four primary transfer rollers 35 (35Y, 35M, 35C, and 35K) corresponding to four image forming development parts 40 (40Y, 40M, 40C, and 40K). Also, the transfer part 30 includes one primary transfer roller 36 corresponding to one development part 50.

The secondary transfer roller 37 has the developers that are transferred to the intermediate transfer belt 31 transferred (secondary-transferred) to the surface of the medium M. This secondary transfer roller 36 is press-contacted by the backup roller 34, and includes a metallic core material and an elastic layer such as a foamed rubber layer that coats the outer-circumference face of the core material for example. Note that the secondary transfer roller 37 can rotate anticlockwise according to the movement of the intermediate transfer belt 31.

The cleaning blade 38 scrapes off unnecessary toners remaining on the surface of the intermediate transfer belt 31.

[Image Forming Development Parts]

The image forming development parts 40 are first development parts that form electrostatic latent images and have image forming developers adhere to the electrostatic latent images utilizing the Coulomb force to form image forming developer images. These image forming developers are developers used to form an image (below-mentioned image information F) on the surface of the medium M.

Here, as mentioned above for example, the image forming apparatus is provided with four image forming development parts 40 (40Y, 40M, 40C, and 40K).

The image forming development parts 40Y, 40M, 40C, and 40K are detachably attached to the chassis 1 and arranged along the moving route of the intermediate transfer belt 31. Here, the image forming development parts 40Y, 40M, 40C, and 40K are, for example, disposed in this order from the upstream side (the side closer to the drive roller 32) toward the downstream side (the side closer to the driven roller 33) in the moving direction of the intermediate transfer belt 31.

The image forming development parts 40Y, 40M, 40C, and 40K have the same configuration as one another, except differing in the kind of the image forming developer contained in the below-mentioned cartridge 48. Specifically, each of the image forming development parts 40Y, 40M, 40C, and 40K includes, as shown in FIG. 2 for example, a photosensitive drum 41, a charging roller 42, a development roller 43, a supply roller 44, a development blade 45, a cleaning blade 46, a light emitting diode (LED) head 47, and a cartridge 48.

The photosensitive drum 41, for example, is an organic-system photoreceptor that includes a cylindrical conductive supporting body and a photoconductive layer coating the outer-circumference face of the conductive supporting body, and can rotate anticlockwise through a drive source such as a motor. The conductive supporting body is a metal pipe containing a metallic material such as aluminum. The photoconductive layer is, for example, a laminated body including a charge generation layer, a charge transportation layer, etc.

The charging roller 42, for example, includes a metal shaft and a semiconductive epichlorohydrin rubber layer coating the outer-circumference face of the metal shaft, and can rotate clockwise. This charging roller 42 is press-contacted by the photosensitive drum 41 to charge the photosensitive drum 41.

The development roller 43, for example, includes a metal shaft and a semiconductive urethane rubber layer coating the outer-circumference face of the metal shaft, and can rotate clockwise. This development roller 43 carries an image forming developer supplied from the supply roller 44 and also has the image forming developer adhere to an electrostatic latent image formed on the surface of the photosensitive drum 41.

The supply roller 44, for example, includes a metal shaft and a semiconductive silicone sponge layer coating the outer-circumference face of the metal shaft, and can rotate anticlockwise. This supply roller 44 supplies the image forming developer to the surface of the photosensitive drum 41 while slide-contacting the development roller 43.

The development blade 45 regulates the thickness of the image forming developer supplied to the surface of the supply roller 44. This development blade 45 is disposed in a position away from the development roller 43 by a prescribed distance, and the thickness of the image forming developer is controlled based on the distance between the development roller 43 and the development blade 45. Also, the development blade 45 contains a metallic material such as stainless steel for example.

The cleaning blade 46 scrapes off unnecessary image forming developer remaining on the surface of the photosensitive drum 41. This cleaning blade 46, for example, extends in a direction that is approximately parallel to the extending direction of the photosensitive drum 41, and is press-contacted by the photosensitive drum 41. Also, the cleaning blade 46 contains a macromolecular material such as urethane rubber for example.

The LED head 47 is an exposure device that forms an electrostatic latent image on the surface of the photosensitive drum 41 by irradiating the surface of the photosensitive drum 41 with light, and for example, includes an LED element, a lens array, etc. The LED element and the lens array are disposed so that light (irradiation light) output from the LED element forms an image on the surface of the photosensitive drum 41.

The cartridge 48 is detachably attached to the image forming development part 40 for example, and contains an image forming developer. Contained in the cartridge 48 of the image forming development part 40Y is a yellow image forming developer for example. Contained in the cartridge 48 of the image forming development part 40M is a magenta image forming developer for example. Containing in the cartridge 48 of the image forming development part 40C is a cyan image forming developer for example. Contained in the cartridge 48 of the image forming development part 40K is a black image forming developer.

[Bonding Development Part]

The bonding development part 50 is a second development part that forms an electrostatic latent image and also forms a bonding developer image by having the bonding developer adhere to the electrostatic latent image utilizing the Coulomb force. This bonding developer is a developer used for forming images (below-mentioned bonding layer H) other than an image on the surface of the medium M.

Here, as mentioned above for example, the image forming apparatus is provided with one bonding development part 50. This bonding development part 50 is detachably attached to the chassis 1 and is also arranged along the moving route of the intermediate transfer belt 31. Here, for example, the bonding development part 50 is disposed in the downstream side of the image forming development parts 40 in the moving direction of the intermediate transfer belt 31.

The bonding development part 50, for example, has the same configuration as the image forming development parts 40 except containing the bonding developer instead of the image forming developers in a cartridge 58. Specifically, the bonding development part 50 includes, for example, a photosensitive drum 51, a charging roller 52, a development roller 53, a supply roller 54, a development blade 55, a cleaning blade 56, an LED head 57, and the cartridge 58.

Note that the configuration of the photosensitive drum 51, the charging roller 52, the development roller 53, the supply roller 54, the development blade 55, the cleaning blade 56, the LED head 57, and the cartridge 58 is, for example, the same as the configuration of the photosensitive drum 41, the charging roller 42, the development roller 43, the supply roller 44, the development blade 45, the cleaning blade 46, the LED head 47, and the cartridge 48.

[Fuser Part]

The fuser part 60 is, for example, so-called a fuser and bonding part, having two functions.

Specifically, the fuser part 60 heats the image forming developers transferred by the transfer part 30 to the surface of the medium M, thereby fusing the image forming developers to the medium M, and also heats the bonding developer transferred by the transfer part 30 to the surface of the medium M where the image forming developers were fused, thereby fusing the bonding developer to the medium M.

Also, in order to form the image structure S, the fuser part 60 heats the medium M where the image forming developers and the bonding developer were fused, thereby bonding the medium M, where the image forming developers were fused, through the bonding developer.

This fuser part 60 includes, for example, a heat application roller 61 and a pressure application roller 62.

The heat application roller 61 includes, for example, a hollow cylindrical core, a heat-resistant elastic layer coating the outer-circumference face of the core, and a resin tube coating the outer-circumference face of the heat-resistant elastic layer. The core contains, for example, a metal material such as aluminum. The heat-resistant elastic layer contains, for example, a macromolecular material such as silicone rubber. The resin tube contains, for example, a copolymer of tetrafluoroethylene and perfluoroalkyl vinyl ether (PFA) or the like.

This heat application roller 61 can rotate clockwise through a drive force such as a motor, and the surface temperature of the heat application roller 61 is, for example, detected by a thermistor disposed in a position away from the heat application roller 61. Note that inside the heat application roller 61 (core) a heater such as a halogen lamp is placed.

The pressure application roller 62 has the same configuration as the heat application roller 61 for example. This pressure application roller 62 is press-contacted by the heat application roller 61 and can rotate anticlockwise according to the rotation of the heat application roller 61.

[Carrying Rollers]

The carrying rollers 71-77 carry the medium M taken out by the forwarding roller 20 inside the chassis 1. When an image is formed on only one side of the medium M, for example, the medium M is carried by the carrying rollers 71-73 along the carrying routes R1 and R2. When images are formed on both sides of the medium M, for example, the medium M is carried by the carrying rollers 71-77 along the carrying routes R1-R5. Note that the details of the carrying routes of the medium M are mentioned below.

[Carrying Route Switching Guides]

The carrying route switching guides 81 and 82 switch the carrying route of the medium M according to conditions such as whether an image is formed on only one side of the medium M or images are formed on both sides of the medium M.

<1-2. Circuit Configuration>

FIG. 4 shows the circuit configuration of the image forming apparatus.

This image forming apparatus is provided with, together with the above-mentioned series of components, a control part 83, an image forming development voltage controller 84, a bonding development voltage controller 85, an image forming supply voltage controller 86, a bonding supply voltage controller 87, an image forming charging voltage controller 88, a bonding charging voltage controller 89, an image forming exposure controller 90, a bonding exposure controller 91, a primary transfer controller 92, a secondary transfer controller 93, a fuser controller 94, a motor controller 95, an interface part 96, a memory 97, a central processing unit (CPU) 100, a sensor 101, and an operation input part 102. In FIG. 4, those development voltage controllers are referred with "D-Volt.," those supply voltage controller are referred with "S-Volt.," and those charging voltage controller are referred with "C-Volt."

The control part 83 controls the whole image forming apparatus, and the operation of the control part 83 is managed by the CPU 100. This control part 83, for example, obtains data for forming an image through the interface part 96 from a host device 103 existing outside the image forming apparatus. Note that the image forming apparatus is operated through the operation input part 102.

The image forming development voltage controller 84 controls the operation, voltage, etc. of the development roller 43, and the bonding development voltage controller 85 controls the operation, voltage, etc. of the development roller 53.

The image forming supply voltage controller 86 controls the operations, voltages, etc. of the supply roller 44 and the development blade 45, and the bonding supply voltage controller 87 controls the operations, voltages, etc. of the supply roller 54 and the development blade 55.

The image forming charging voltage controller 88 controls the operation, voltage, etc. of the charging roller 42, and the bonding charging voltage controller 89 controls the operation, voltage, etc. of the charging roller 52.

The image forming exposure controller 90 controls the operation, exposure conditions, etc. of the LED head 47, and the bonding exposure controller 91 controls the operation, exposure conditions, etc. of the LED head 57.

The primary transfer controller 92 controls the operations, voltages, etc. of the primary transfer rollers 35 and 36, and the secondary transfer controller 93 controls the operation, voltage, etc. of the secondary transfer roller 37.

The fuser controller 94 controls the operation, heat application conditions, etc. of the heat application roller 61, and also controls the operation, pressure application conditions, etc. of the pressure application roller 62.

The motor controller 95 mainly controls the operations etc. of motors used for driving the forwarding roller 20, the drive roller 32, the photosensitive drums 41 and 51, the carrying rollers 71-77, etc.

The memory 97, for example, includes a read-only memory (ROM) 98, a random-access memory (RAM) 99, etc. Stored in the memory 97 is, for example, information on the image forming operation flow, the computation formula for various types of corrections, etc.

The sensor 101, for example, includes a sensor that detects the leading edge position of the medium M, a sensor that detects temperature, a sensor that detects humidity, etc.

1-3. Configuration and Physical Properties of the Developers

Explained here are physical properties of the developers used for the image forming apparatus.

[Configuration of the Developers]

The image forming developers are, as mentioned above, developers used for forming images (image information F), and contain image forming pigments and image forming macromolecular compounds. Although the forming method of these image forming developers is not particularly limited, for example, one or more types from the emulsion polymerization method and the like are adopted. In these image forming developers, for example, image forming pigments are fused with the surface of particles containing image forming macromolecular compounds.

The image forming pigments are one or more types of so-called coloring agents. The types of these image forming pigments are determined, for example, according to the types of colors necessary for forming images. Specifically, the image forming pigments contained in the yellow image forming developer are one or more types of PY (Pigment Yellow)—74 and the like for example. The image forming pigments contained in the magenta image forming developer are one or more types of PR (Pigment Red)—122 and the like for example. The image forming pigments contained in the cyan image forming developer are one or more types of PB (Pigment Blue)—15:3 and the like for example. The image forming pigments contained in the black image forming developer are one or more types of carbon black and the like for example.

The types of image forming macromolecular compounds are not particularly limited as long as they are one or more types of macromolecular compounds that can hold the image forming pigments. These image forming macromolecular compounds may be homopolymers, copolymers, or mixtures of two or more types of them. Specifically, the image forming macromolecular compounds are, for example, styrene-acrylic copolymers and the like.

Note that the image forming developers may contain one or more types of other materials together with the above-mentioned image forming pigments and image forming macromolecular compounds.

The other materials are, for example, waxes, external additives, conductive agents, etc. The waxes are, for example, stearyl stearate, etc. The external additives are, for example, hydrophobic silica, etc. The conductive agents are, for example, titanium oxides, etc.

As mentioned above, the bonding developer is a developer used for forming an image (bonding layer H) other than the image, and contains the bonding macromolecular compounds. Although the formation method of this bonding developer is not particularly limited, for example, it is one or more types of the pulverization method, the emulsion polymerization method, and the like. Because this bonding developer is not a developer used for forming the image as mentioned above, it does not need to contain image forming pigments. However, the bonding developer may contain image forming pigments as necessary.

The types of the bonding macromolecular compounds are not particularly limited as far as it is one or more types of macromolecular compounds that can perform adhesiveness responding to heating. These image forming macromolecular compounds may be homopolymers, copolymers, or mixtures of two or more types of them. Specifically, the bonding macromolecular compounds are, for example, polyester, etc.

Note that the types of the image forming macromolecular compounds and the types of the bonding macromolecular compounds may be either the same or different. Above all, the types of the image forming macromolecular compounds and the types of the bonding macromolecular compounds should preferably be different. As mentioned below, it is because the solubility parameter δ1 of the image forming macromolecular compounds and the solubility parameter δ2 of the bonding macromolecular compounds can be made sufficiently different, thereby it becomes easier to adjust the difference between those solubility parameters δ1 and δ2.

[Physical Properties of the Developers 1]

In order to improve the quality of the image structure S formed using the image forming apparatus, the physical properties of the developers are adjusted.

Specifically, as mentioned above, once the image forming developers are transferred to the surface of the medium M by the transfer part 30, in the fuser part 60, by the heat application roller 61 heating the medium M, the image forming developers are fused with the surface of the medium M. Also, once the bonding developer is transferred by the transfer part 30 to the surface of the medium M to which the image forming developers were transferred, in the fuser part 60, by the heat application roller 61 heating the medium M, the bonding developer is fused with the surface of the medium M.

Paying attention to fusing temperature (heating temperature for the medium M) by this fuser part 60 (heat application roller 61), heating temperature T1 (° C.) for the image forming developers and heating temperature T2 (° C.) for the bonding developer satisfy a condition expressed by Eq. (1) below. That is, the heating temperature T1 is set to be higher than the heating temperature T2, and the difference between those heating temperatures T1 and T2 is adjusted to be within a prescribed range.

$$10^\circ\ \mathrm{C.} \leq T1 - T2 \leq 30^\circ\mathrm{C.} \quad (1)$$

In this case, paying attention to the physical properties of the image forming macromolecular compounds contained in the image forming developers and the physical properties of the bonding macromolecular compounds contained in the bonding developer, the solubility parameter δ1 $((\mathrm{cal/cm^3})^{1/2})$ of the image forming macromolecular compounds and the solubility parameter δ2 $((\mathrm{cal/cm^3})^{1/2})$ of the bonding macromolecular compounds satisfy a condition expressed by Eq. (2) below. That is, although the magnitude relation between the solubility parameters δ1 and δ2 is not particularly limited, the absolute value of the difference between those solubility parameters δ1 and δ2 is adjusted to be within a prescribed range.

$$5.9 \leq |\delta 1 - \delta 2| \leq 7.4 \quad (2)$$

In the case where the heating temperatures T1 and T2 satisfy the condition shown in Eq. (1), the reason that the solubility parameters δ1 and δ2 satisfy the condition shown in Eq. (2) is that (the absolute value of) the difference between the solubility parameters δ1 and δ2 is adjusted in relation to the difference between the heating temperatures T1 and T2. Thereby, in the image structure S formed using the image forming apparatus, image migration caused by mixing (compatibility) between the image forming developers and the bonding developer is suppressed, and adhesiveness using the bonding developer is secured. Therefore, both suppressing the image migration and securing the adhesiveness can be achieved.

[Physical Properties of the Developers 2]

Alternatively, as mentioned above, once the image forming developers are transferred to the surface of the medium M by the transfer part 30, in the fuser part 60, by the pressure application roller 62 applying a pressure to the medium M, the image forming developers are fused with the surface of the medium M. Also, once the bonding developer is transferred by the transfer part 30 to the surface of the medium M to which the image forming developers were transferred, in the fuser part 60, by the heat application roller 61 and the pressure application roller 62 applying a heating and a pressure to the medium M, the bonding developer is fused with the surface of the medium M.

Paying attention to a press-contact force (an applied pressure to the medium M) by this fuser part 60 (pressure application roller 62), the applied pressure P ($kg/cm^2$) of the bonding developer satisfies a condition expressed by Eq. (3) below. That is, when the pressure application roller 62 press-contacts the heat application roller 61 through the medium M, the applied pressure P supplied to the medium M from the pressure application roller 62 is adjusted to be within a prescribed range. The applied pressure P explained here is so-called a nip pressure.

$$1.5\ kg/cm^2 \leq P \leq 3.5\ kg/cm^2 \quad (3)$$

In this case, paying attention to the physical properties of the image forming macromolecular compounds and the physical properties of the bonding macromolecular compounds, the solubility parameter δ1 ($(cal/cm^3)^{1/2}$) of the image forming macromolecular compounds and the solubility parameter δ2 ($(cal/cm^3)^{1/2}$) of the bonding macromolecular compounds satisfy a condition expressed by Eq. (4) below. That is, although the magnitude relation between the solubility parameters δ1 and δ2 is not particularly limited, the absolute value of the difference between those solubility parameters δ1 and δ2 is adjusted to be within a prescribed range.

$$5.8 \leq |\delta 1 - \delta 2| \leq 7.5 \quad (4)$$

In the case where the applied pressure P satisfies the condition shown in Eq. (3), the reason why the solubility parameters δ1 and δ2 satisfy the condition shown in Eq. (4) is that (the absolute value of) the difference between the solubility parameters δ1 and δ2 is adjusted in relation to the applied pressure P. Thereby, in the same manner as in the case where (the absolute value of) the difference between the solubility parameters δ1 and δ2 is adjusted in relation to the difference between the heating temperatures T1 and T2, both suppressing the image migration and securing the adhesiveness can be achieved.

[Parameters Influencing the Physical Properties of the Developers]

Details concerning the parameters (heating temperatures T1 and T2, applied pressure P, and solubility parameters δ1 and δ2) that influence the physical properties of the developers mentioned above are as follows.

As mentioned above, the heating temperature T1 is the temperature at which the heat application roller 61 heats the medium M for fusing the image forming developers with the surface of the medium M in the fuser part 60 after the image forming developers are transferred to the surface of the medium M. Therefore, in order to specify the heating temperature T1, for example, the temperature at which the heat application roller 61 heats the medium M to which the image forming developers were transferred, that is, the surface temperature of the heat application roller 61 may be measured.

As mentioned above, the heating temperature T2 is the temperature at which the heat application roller 61 heats the medium M for fusing the bonding developer with the surface of the medium M in the fuser part 60 after the bonding developer is transferred to the surface of the medium M. Therefore, in order to specify the heating temperature T2, for example, the temperature when the heat application roller 61 heats the medium M to which the bonding developer was transferred, that is, the surface temperature of the heat application roller 61 may be measured.

As mentioned above, the applied pressure P is the pressure supplied to the medium M from the pressure application roller 62 for fusing the bonding developer on the surface of the medium M in the fuser part 60 after the bonding developer is transferred to the surface of the medium M. Therefore, in order to specify the applied pressure P, for example, the pressure when the pressure application roller 62 press-contacts the heat application roller 61 through the medium M, to which the bonding developer was transferred, may be measured.

The solubility parameters δ1 and δ2 are specified through the following procedure.

Here, in order to simplify the explanation, a solubility parameter 8 in general is explained. In this case, by computing the solubility parameter δ using the image forming macromolecular compounds as the below-explained macromolecular compounds, the solubility parameter δ1 of the image forming macromolecular compounds can be obtained. Also, by computing the solubility parameter δ using the bonding macromolecular compounds as the macromolecular compounds, the solubility parameter δ2 of those bonding macromolecular compounds can be obtained.

The solubility parameter δ is a measure to express the intermolecular force of a material. When the solubility parameters of two materials are compared, the smaller the difference between those two solubility parameters δ is, the larger the solubility becomes, therefore it becomes easier for those two materials to mix (be compatible). On the other hand, the larger the difference between those two solubility parameters δ is, the smaller the solubility becomes, therefore it becomes more difficult for those two materials to mix (be compatible).

This solubility parameter δ is expressed by Eqs. (5)-(7) below based on the result of measurements using the turbidimetric titration method.

$$\delta = X/Y \quad (5)$$

$$X = V_{ml}^{1/2} \cdot \delta_{ml} + V_{mh}^{1/2} \cdot \delta_{mh} \quad (6)$$

($V_{ml}$ is the volume of a poor solvent 1 having a relatively small solubility parameter. $V_{mh}$ is the volume of a poor solvent 2 having a relatively large solubility parameter. $\delta_{ml}$ is the solubility parameter of the poor solvent 1 having a relatively small solubility parameter. $\delta_{mh}$ is the solubility parameter of the poor solvent 2 having a relatively large solubility parameter.)

$$Y = V_{ml}^{1/2} + V_{mh}^{1/2} \quad (7)$$

($V_{ml}$ is the volume of the poor solvent 1 having a relatively small solubility parameter. $V_{mh}$ is the volume of the poor solvent 2 having a relatively large solubility parameter.)

The turbidimetric titration method is a method of measuring the amount of a poor solvent required to generate turbidity by dropping the poor solvent into a good solvent in which macromolecular compounds are dissolved beforehand In this turbidimetric titration method, by performing the above-mentioned measurement using the poor solvent 1 having a relatively small solubility parameter, the amount of the poor solvent 1 required to generate turbidity is measured, and also by performing the above-mentioned measurement using the poor solvent 2 having a relatively large solubility parameter, the amount of the poor solvent 2 required to generate turbidity is measured.

The specific procedure is as follows for example. First, 10 ml of acetone is injected to a 100 ml beaker containing 0.5 g of macromolecular compounds. Thereby, because the macromolecular compounds are dissolved by acetone, an acetone solution containing the macromolecular compounds is obtained. In this case, two acetone solutions are prepared. Subsequently, while stirring one of the acetone solutions, by dropping the poor solvent 1 (for example, n-hexane) into the acetone solution using a burette, the amount ($V_{ml}$: ml) of the poor solvent 1 required to generate turbidity is examined. Subsequently, while stirring the other acetone solution, by dropping the poor solvent 2 (for example, deionized water) into the acetone solution using a burette, the amount ($V_{mh}$: ml) of the poor solvent 2 required to generate turbidity is examined. In these cases, temperature of the poor solvents 1 and 2 is set to 20° C. One example, these compounds are composed in a fashion as follow:

acetone δ: 10.3, n-hexane: 7.1, deionized water: 23.2.

Not to mention, these proportion varies according to a required function or condition.

[Summary of the Physical Properties of the Developers]

Note that concerning the physical properties of the developers, either only the above-mentioned condition on [Physical properties of the developers 1] may be satisfied, only the above-mentioned condition on [Physical properties of the developers 2] may be satisfied, or the both conditions may be satisfied. Above all, if the both conditions are satisfied, higher effects can be obtained.

<1-4. Configuration of the Image Structure>

Figure 5:
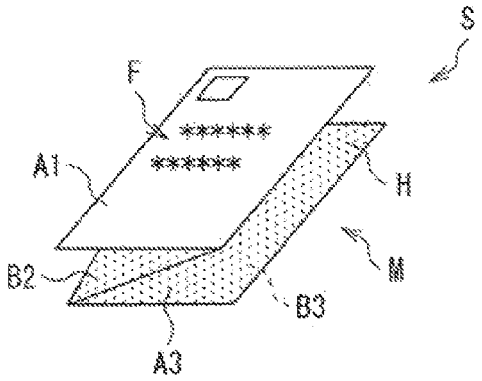
FIG. 5 is a perspective view for configuring an image structure.
Figure 6:
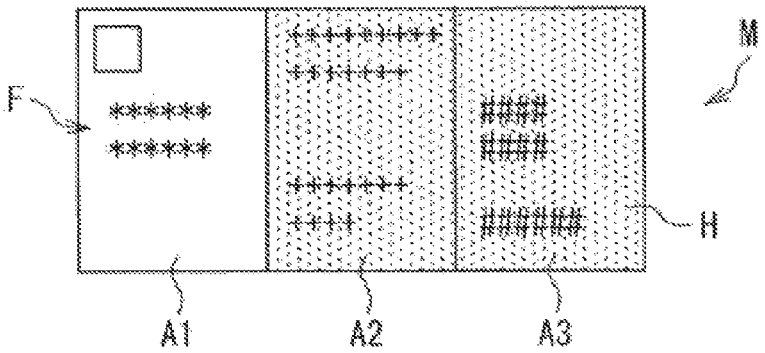
FIG. 6 is a plan view showing the front-side configuration of a medium used for forming the image structure.
Figure 7:
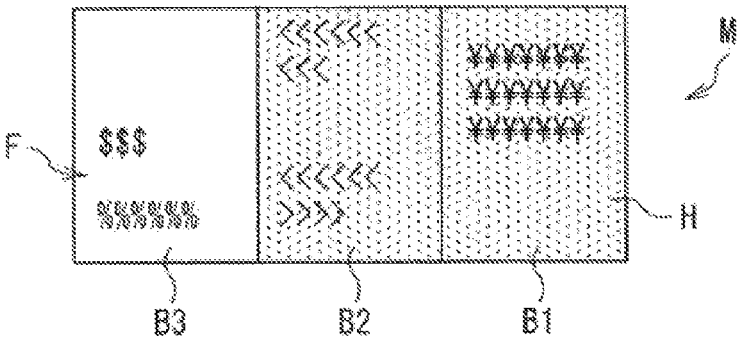
FIG. 7 is a plan view showing the back-side configuration of the medium used for forming the image structure.

FIG. 5 shows the perspective-view configuration of the image structure S for explaining the configuration of the image structure S formed using the image forming apparatus. FIG. 6 shows the front-side planar configuration of the medium M used for forming the image structure S, and FIG. 7 shows the back-side planar configuration of the medium M used for forming the image structure S. Note that shown in FIG. 5 is a state before the medium M is bonded (thermally crimped).

The image structure S is formed using the medium M where the image (image information F) and the bonding layer H are formed. The configuration of this image structure S is not particularly limited as long as the image is formed on one side or both sides of the medium M, and as long as the medium M is folded once or more and afterwards bonded through the bonding layer H while maintaining its folded state.

The image structure S explained here, for example, is a crimped postcard having the following structure. The image information F is formed on both sides of the medium M. This image information F, for example, contains one or more types of characters, codes, figures, etc. The medium M having the image information F formed on both sides is folded in a Z shape. In a state of being folded in a Z shape, this medium M is bonded through the bonding layer H so as to form a piece of sheet (postcard) shape. Note that in FIGS. 5-7, hatching is applied to the bonding layer H.

The image information F is the image forming developers (image forming developer images) that are transferred to and fused with the surface of the medium M. On the other hand, the bonding layer H is the bonding developer (bonding developer image) that is transferred to and fused with the surface of the medium M after the image forming developers (image forming developer images) are transferred to and fused with the surface of the medium M.

Specifically, the medium M used for forming the image structure S has three faces A1, A2, and A3 that are sequentially arranged in the longitudinal direction on the front side. The image information F is, for example, formed on each of the faces A1, A2, and A3. The bonding layer H is, for example, not formed on the face A1 but formed on the faces A2 and A3. It is because the face A1 is a face that becomes the frontmost face of the image structure S, therefore the image information F formed on the face A1 does not need to be concealed.

Also, the medium M used for forming the image structure S has three faces B1, B2, and B3 that are sequentially arranged in the longitudinal direction on the back side. The faces A1 and B1 are in a front and back relationship, the faces A2 and B2 are in a front and back relationship, and the faces A3 and B3 are in a front and back relationship. The image information F is, for example, formed on each of the faces B1, B2, and B3. The bonding layer H is, for example, not formed on the face B3 but formed on the faces B1 and B2. It is because the face B3 is a face that becomes the backmost face of the image structure S, therefore the image information F formed on the face B3 does not need to be concealed.

When the image structure S is formed, as mentioned above, after the medium M where the image information F and the bonding layer H are formed is folded in a Z shape, the bonding layer H formed on the face B1 and the bonding layer H formed on the face B2 are bonded, and the bonding layer H formed on the face A2 and the bonding layer H formed on the face A3 are bonded. Thereby, in the medium M after bonding, the face A1 becomes the frontmost face of the image structure S, and the face B3 becomes the backmost face of the image structure S.

In this image structure S, because part of the front face (face A1) and part of the back face (face B3) are exposed, the image information F formed on those faces A1 and B3 can be read. As opposed to this, because the image information F formed on part of the front face (faces A2 and A3) and part of the back face (faces B1 and B2) is concealed, the information F formed on those faces A2, A3, B1, and B2) cannot be read.

However, the faces A2 and A3 bonded using the bonding layer H are easily peelable, and in the same manner, the faces B1 and B2 bonded using the bonding layer H are easily peelable. Therefore, by having the faces A2 and A3 peeled off, the image information F formed on those faces A2 and A3 can be read, and by having the faces B1 and B2 peeled off, the image information formed on those faces B1 and B2 can be read.

<2. Operations of the Image Forming Apparatus>

Next, explanations are given on the operations of the image forming apparatus.

Here, the mechanical operations of the image forming apparatus are explained referring mainly to FIGS. 1-3 and 5-7. Here, cited as an example is a case where the medium M contained in the tray 11 is used, and images (image information F) are formed on both sides of the medium M.

In this image forming apparatus, as explained below for example, the image structure S is formed by performing an image forming process, a bonding layer H forming process, and a medium M bonding process in this order.

2-1. Image Forming Process

When images are formed on both sides of the medium M, for example, a development process (front face), a primary transfer process (front face), a secondary transfer process (front face), a fusing process (front face), a development process (back face), a primary transfer process (back face), a secondary transfer process (back face), and a fusing process (back face) are performed in this order. Note that the processes with "front face" in parentheses appended are processes applied to the front face of the medium M, and the processes with "back face" in parentheses appended are processes applied to the back face of the medium M.

[Development Process (Front Face)]

The medium M contained in the tray 11 is carried in the direction of an arrow F1 along the carrying route R1 by the carrying rollers 71 and 72. The medium M contained in this tray 11 is taken out by the forwarding roller 21.

In the development process, once the photosensitive drum 41 rotates in the image forming development part 40Y, the charging roller 42 applies a direct-current voltage to the surface of the photosensitive drum 41 while rotating. Thereby, the surface of the photosensitive drum 41 is uniformly charged.

Subsequently, the LED head 47 irradiates the surface of the photosensitive drum 41 with light according to an image signal. Thereby, because the surface potential is attenuated (optical attenuation) on the light-irradiated part of the surface of the photosensitive drum 41, an electrostatic latent image is formed on the surface of the photosensitive drum 41.

On the other hand, in the image forming development part 40Y, the yellow image forming developer contained in the cartridge 48 is discharged to the supply roller 44.

Once a voltage is applied to the supply roller 44, the supply roller 44 rotates. Thereby, the yellow image forming developer is supplied from the cartridge 48 to the surface of the supply roller 44.

Once a voltage is applied to the development roller 43, the development roller 43 rotates while being press-contacted by the supply roller 44. Thereby, because the yellow image forming developer supplied to the surface of the supply roller 44 is adsorbed to the surface of the development roller 43, the image forming developer is carried utilizing the rotation of the development roller 43. In this case, because part of the yellow image forming developer adsorbed to the surface of the development roller 43 is removed by the development blade 45, the thickness of the yellow image forming developer adsorbed to the surface of the development roller 43 is homogenized.

Once the photosensitive drum 41 rotates while being press-contacted by the development roller 43, because the yellow image forming developer adsorbed to the surface of the development roller 43 migrates to the surface of the photosensitive drum 41, a yellow image forming developer image is formed on the surface of the photosensitive drum 41.

[Primary Transfer Process (Front Face)]

In the transfer part 30, once the drive roller 32 rotates, the driven roller 33 and the backup roller 34 rotate according to the rotation of the drive roller 32. Thereby, the intermediate transfer belt 31 moves in the direction of an arrow F5.

In the primary transfer process, a voltage is applied to the primary transfer roller 35Y. Because this primary transfer roller 35Y is press-contacted by the photosensitive drum 41 through the intermediate transfer belt 31, the yellow image forming developer image formed on the surface of the photosensitive drum 41 in the above-mentioned development process is transferred to the surface of the intermediate transfer belt 31.

Afterwards, the intermediate transfer belt 31, to which the yellow image forming developer image was transferred, continues to move in the direction of the arrow F5. Thereby, in the image forming development parts 40M, 40C, and 40K, and the primary transfer rollers 35M, 35C, and 35K, the development processes and the primary transfer processes are sequentially performed in the same manner as in the image forming development part 40Y and the primary transfer roller 35Y mentioned above. Therefore, image forming developer images of individual colors (magenta, cyan, and black) are sequentially transferred to the surface of the intermediate transfer belt 31.

That is, a magenta image forming developer image is transferred to the surface of the intermediate transfer belt 31 by the image forming development part 40M and the primary transfer roller 35M. Subsequently, a cyan image forming developer image is transferred to the surface of the intermediate transfer belt 31 by the image forming development part 40C and the primary transfer roller 35C. Subsequently, a black image forming developer image is transferred to the surface of the intermediate transfer belt 31 by the image forming development part 40K and the primary transfer roller 35K.

Needless to say, whether the development process and the transfer process are actually performed in each of the image forming development parts 40Y, 40M, 40C, and 40K, and the primary transfer rollers 35Y, 35M, 35C, and 35K is determined according to the necessary colors (types of image forming developers) for forming the image information F.

[Secondary Transfer Process (Front Face)]

The medium M carried along the carrying route R1 passes between the backup roller 34 and the secondary transfer roller 37.

In the secondary transfer process, a voltage is applied to the secondary transfer roller 37. Because this secondary transfer roller 37 is press-contacted by the backup roller 34 through the medium M, the image forming developer images transferred to the surface of the intermediate transfer belt 31 in the primary transfer process mentioned above are transferred to the surface of the medium M.

[Fusing Process (Front Face)]

The medium M, to which the image forming developer images were transferred in the secondary transfer process, continues to be carried in the direction of the arrow F1 along the carrying route R1, and is thereby injected to the fuser part 60.

In the fusing process, the surface temperature of the heat application roller 61 is controlled to be prescribed temperature. Once the pressure application roller 62 rotates in a state of being press-contacted by the heat application roller 61, the medium M is carried so as to pass between the heat application roller 61 and the pressure application roller 62.

Thereby, because the image forming developer images transferred to the surface of the medium M are heated by the heat application roller 61, those image forming developer images melt. Also, because the image forming developer images in a molten state are press-contacted by the pressure application roller 62 to the medium M, those image forming developer images solidly adhere to the surface of the medium M. Thereby, the image forming developers are fused with the front face (faces A1, A2, and A3) of the medium M, forming the image information F.

[Development Process (Back Face), Primary Transfer Process (Back Face), Secondary Transfer Process (Back Face), and Fusing Process (Back Face)]

After passing through the fuser part 60, the medium M having the image information F formed on the faces A1, A2, and A3 is carried in the directions of arrows F3 and F4 by the carrying rollers 74-77 along the carrying routes R3-R5, and afterwards carried again in the direction of the arrow F1 by the carrying rollers 71 and 72 along the carrying route R1. In this case, the direction in which the medium M is carried is controlled by the carrying route switching guides 81 and 82.

Thereby, on the back face of the medium M, the development process, the primary transfer process, the secondary transfer process, and the fusing process mentioned above are performed again in this order. Thereby, the image information F is formed on the back face (faces B1, B2, and B3) of the medium M.

The medium M having the image information F formed on the front face (faces A1, A2, and A3) and the back face (faces B1, B2, and B3) is carried in the direction of an arrow F2 by the carrying roller 73 along the carrying route R2, and is thereby forwarded to the stacker part 2.

2-2. Bonding Layer Forming Process

When forming the bonding layer H on both sides of the medium M, for example, the development process (front face), the primary transfer process (front face), the secondary transfer process (front face), the fusing process (front face), the development process (back face), the primary transfer process (back face), the secondary transfer process (back face), and the fusing process (back face) are performed in this order. In this case, the medium M having the image information F formed on both sides is set in the tray 11.

Note that the processing content of each of the development process, the primary transfer process, the secondary transfer process, and the fusing process in the bonding layer H forming process is the same as the processing content of each of the development process, the primary transfer process, the secondary transfer process, and the fusing process in the image forming process, except using the bonding layer development part 50 (bonding developer) instead of the image forming development parts 40 (image forming developers). Therefore, explanations below that are duplicates of the explanations on the image forming process are omitted at any time.

[Development Process (Front Face)]

The medium M that has the image formation already done and is contained in the tray 11 is carried in the direction of the arrow F1 along the carrying route R1 by the carrying rollers 71 and 72.

In the development process, once the photosensitive drum 51 rotates in the bonding development part 50, the surface of the photosensitive drum 51 is uniformly charged through the charging roller 52. Subsequently, according to an image signal, the LED head 57 irradiates the surface of the photosensitive drum 51 with light, thereby forming an electrostatic latent image on the surface of the photosensitive drum 51. On the other hand, in the bonding development part 50, the bonding developer contained in the cartridge 58 is supplied to the surface of the supply roller 54. Once the development roller 53 rotates while being press-contacted by the supply roller 54, the bonding developer supplied to the surface of the supply roller 54 is adsorbed to the surface of the development roller 53, thereby the bonding developer is carried utilizing the rotation of the development roller 53. In this case, the thickness of the bonding developer is homogenized by the development blade 55. Once the photosensitive drum 51 rotates while being press-contacted by the development roller 53, the bonding developer adsorbed to the surface of the development roller 53 migrates to the surface of the photosensitive drum 51, thereby the bonding developer image is formed on the surface of the photosensitive drum 51.

[Primary Transfer Process (Front Face)]

In the transfer part 30, because the driven roller 33 and the backup roller 34 rotate according to the rotation of the drive roller 32, the intermediate transfer belt 31 moves in the direction of the arrow F5. In the primary transfer process, because the primary transfer roller 36 is press-contacted by the photosensitive drum 51 through the intermediate transfer belt 31, the bonding developer image formed on the surface of the photosensitive drum 51 is transferred to the surface of the intermediate transfer belt 31.

[Secondary Transfer Process (Front Face)]

The medium M carried along the carrying route R1 passes between the backup roller 34 and the secondary transfer roller 37. In the secondary transfer process, because the secondary transfer roller 37 is press-contacted by the backup roller 34 through the medium M, the bonding developer image transferred to the surface of the intermediate transfer belt 31 in the primary transfer process mentioned above is transferred to the front face of the medium M.

[Fusing Process (Front Face)]

The medium M to which the bonding developer image was transferred in the secondary transfer process continues to be carried in the direction of the arrow F1 along the carrying route R1, and is thereby injected to the fuser part 60. In the fusing process, because the pressure application roller 62 rotates in a state of being press-contacted by the heat application roller 61, the medium M is carried so as to pass between the heat application roller 61 and the pressure application roller 62. Thereby, the bonding developer image transferred to the front face of the medium M is heated by the heat application roller 61, therefore the bonding developer image melts. Also, because the bonding developer image in a molten state is press-contacted by the pressure application roller 62 to the medium M, the bonding developer image solidly adheres to the front face of the medium M. Therefore, the bonding developer is fused with part of the front face (faces A2 and A3) of the medium M, thus forming the bonding layer H.

[Development Process (Back Face), Primary Transfer Process (Back Face), Secondary Transfer Process (Back Face), and Fusing Process (Back Face)]

After passing through the fuser part 60, the medium M having the bonding layer H formed on the faces A2 and A3 is carried in the directions of the arrows F3 and F4 by the carrying rollers 74-77 along the carrying routes R3-R5, and afterwards is carried again in the direction of the arrow F1 by the carrying rollers 71 and 72 along the carrying route R1. In this case, the direction in which the medium M is carried is controlled by the carrying route switching guides 81 and 82. Thereby, on the back face of the medium M, the development process, the primary transfer process, the secondary transfer process, and the fusing process mentioned above are performed in this order. Thereby, the bonding layer H is formed on part of the back face (faces B1 and B2) of the medium M.

The medium M having the bonding layer H formed on part of the front face (faces A2 and A3) and part of the back face (faces B1 and B2) is carried in the direction of the arrow F2 by the carrying roller 73 along the carrying route R2, and is thereby forwarded to the stacker part 2.

2-3. Bonding Process of the Medium

In order to form the image structure S, when bonding the medium M using the bonding layer H, for example, a bonding process is performed in the fuser part 60. In this case, after folding in a Z shape the medium M on which the image information F and the bonding layer H are formed, the medium M is set in the tray 11 in the folded state.

The folded medium M contained in the tray 11 is carried in the direction of the arrow F1 along the carrying route R1 by the carrying rollers 71 and 72, and is thereby injected to the fuser part 60 without having the development process, the primary transfer process, the secondary transfer process, or the fusing process performed.

In the bonding process, the surface temperature of the heat application roller 61 is controlled to be equal to or higher than the melting temperature of the bonding layer H. Once the pressure application roller 62 rotates in a state of being press-contacted by the heat application roller 61, the medium M is carried so as to pass between the heat application roller 61 and the pressure application roller 62.

Thereby, the folded medium M is heated by the heat application roller 61, therefore the bonding layer H melts. Also, because the pressure application roller 62 applies a pressure to the folded medium M, the faces A2 and A3 are bonded using the bonding layer H, and the faces B1 and B2 are bonded using the bonding layer H. Thereby, the image structure S in a single sheet shape is formed.

The image structure S is carried in the direction of the arrow F2 by the carrying roller 73 along the carrying route R2, and is thereby forwarded to the stacker part 2.

3. Actions and Effects of the Image Forming Apparatus

According to this image forming apparatus, the following conditions are satisfied concerning the physical properties of the image forming macromolecular compounds and the physical properties of the bonding macromolecular compounds (solubility parameters δ1 and δ2).

Paying attention to the fusing temperature (heating temperature for the medium M) by the fuser part 60 (heat application roller 61), if the heating temperature T1 (° C.) for the image forming developers and the heating temperature T2 (° C.) for the bonding developer satisfy $10° C. \leq T1 - T2 \leq 30° C.$, the solubility parameters δ1 and δ2 satisfy $5.9 \leq |\delta 1 - \delta 2| \leq 7.4$.

Alternatively, paying attention to the press-contact force (applied pressure to the medium M) by the fuser part 60 (pressure application roller 62), if the applied pressure P ($kg/cm^2$) to the bonding developer satisfies $1.5\ kg/cm^2 \leq P \leq 3.5\ km/cm^2$, the solubility parameters δ1 and δ2 satisfy $5.8 \leq |\delta 1 - \delta 2| \leq 7.5$.

In this case, as mentioned above, (the absolute value of) the difference between the solubility parameters δ1 and δ2 is adjusted in relation to the difference between the heating temperatures T1 and T2, and also (the absolute value of) the difference between the solubility parameters δ1 and δ2 is adjusted in relation to the applied pressure P. Thereby, in the bonding process of the medium M, because the image forming developers forming the image information F and the bonding developer forming the bonding layer H become hard to mix (be compatible) in a molten state, a phenomenon that the image information F unintentionally migrates from the medium M to the bonding layer H (image migration) is suppressed. Furthermore, while suppressing the compatibility between the image forming developers and the bonding developer, the faces A2 and A3 are sufficiently bonded using the bonding layer H, and the faces A2 and A3 are sufficiently bonded using the bonding layer H in the same manner, thereby the adhesiveness of the image structure S is also secured. Therefore, both suppressing the image migration and securing the adhesiveness of the image structure S can be achieved, allowing an improvement in the quality of the image structure S.

Especially, if the types of the image forming macromolecular compounds and the types of the bonding macromolecular compounds are different, the difference between the solubility parameters δ1 and δ2 tends to become large, thereby it becomes easy to satisfy the condition on the difference between the solubility parameters δ1 and δ2 mentioned above. Therefore, higher effects can be obtained.

4. Modifications

The configuration of the image forming apparatus mentioned above can be appropriately modified.

Figure 8:
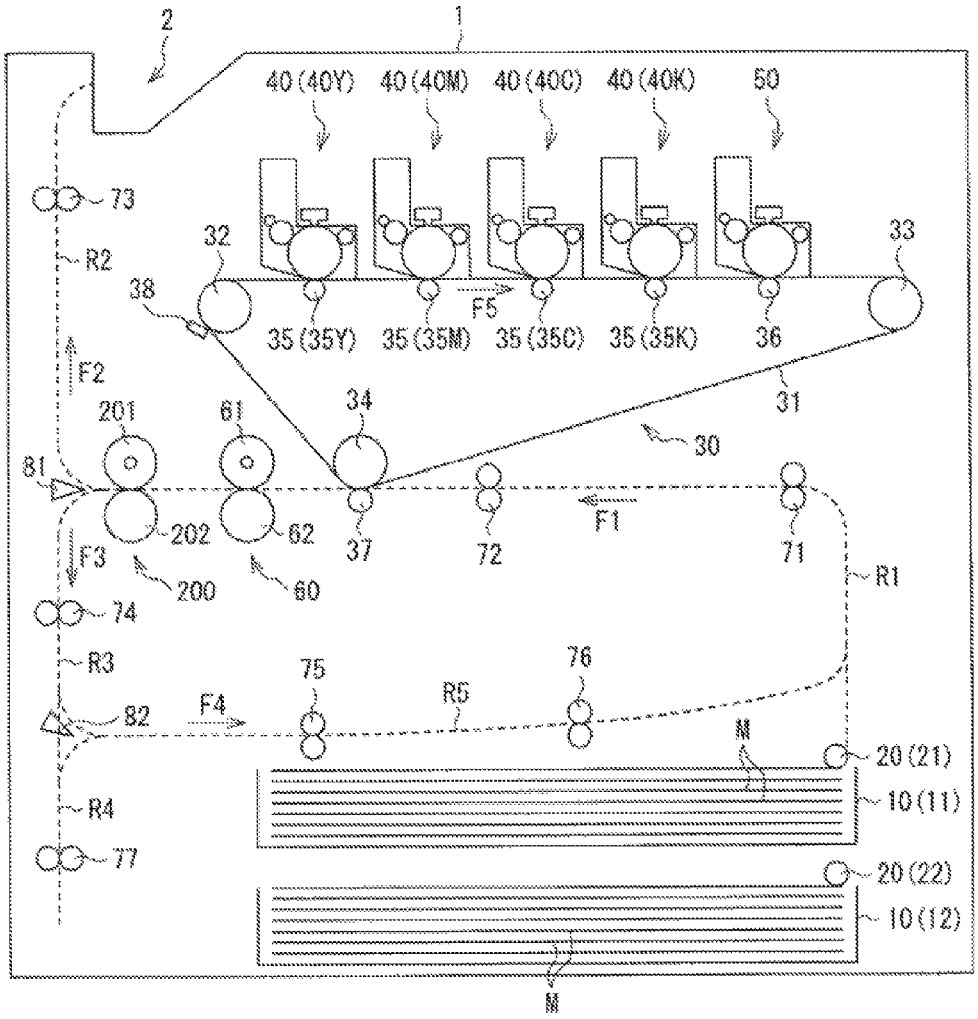
FIG. 8 is a diagram showing a modification of the configuration of the image forming apparatus.

In FIG. 1, because the fuser part 60 is so-called a fuser and bonding part, it performs both the fusing process and the bonding process. However, as shown in FIG. 8 corresponding to FIG. 1 for example, in the downstream side of the fuser part 60 in the carrying route R1 of the medium M, a bonding part 200 that performs the bonding process may be provided separately from the fuser part 60 that performs the fusing process. In this case, the fuser part 60 performs the fusing process, and the bonding part 200 performs the bonding process.

The bonding part 200 heats the medium M having the image forming developers and the bonding developer fused by the fuser part 60, and thereby bonds the medium M, where the image forming developers were fused, through the bonding developer. This bonding part 200, for example, has the same configuration as the fuser part 60, and specifically includes a heat application roller 201 and a pressure application roller 202. The configuration and functions of the heat application roller 201 are, for example, the same as the configuration and functions of the heat application roller 61. The configuration and functions of the pressure application roller 202 are, for example, the same as the configuration and functions of the pressure application roller 62. In this case also, the fusing process is performed by the fuser part 60, and the bonding process is performed by the bonding part 200, therefore the same effects can be obtained.

However, as mentioned above, the bonding part 200 would substantially have the same configuration as the fuser part 60. Therefore, in order to achieve miniaturization, simplification, etc. of the image forming apparatus, as shown in FIG. 1, the fuser part 60 should preferably perform both the fusing process and the bonding process by having both its original functions and the functions of the bonding part 200.

Also, for example, in order to form the image structure S, although images were formed on both sides of the medium M using the image forming apparatus, an image may be formed on only one side of the medium M.

Besides, the image forming apparatus may, for example, simply be used for only forming images on one side or both sides of the medium M without forming the image structure S.

When forming an image on only one side of the medium M using the image forming apparatus, for example, the medium M that passed through the fuser part 60 is carried in the direction of the arrow F2 by the carrying roller 73 along the carrying route R2.

Also, when forming an image multiple times on only one side of the medium M using the image forming apparatus, for example, the medium M that passed through the fuser part 60 is carried in the directions of the arrows F3 and F4 by the carrying rollers 74-76 along the carrying routes R3 and R5, and is afterwards carried again in the direction of the arrow F1 by the carrying rollers 71 and 72 along the carrying route R1. In this case, the direction in which the medium M is carried is controlled by the carrying route switching guides 81 and 82. Thereby, on one face (the face on which an image is already formed) of the medium M, the development process, the primary transfer process, the secondary transfer process, and the fusing process are performed again.

Embodiments

An embodiment of this invention is explained in detail. Note that the order of the explanations is as follows. 1.

Relationship between the heating temperatures T1 and T2 and the solubility parameters δ1 and δ2. 2. Relationship between the applied pressure P and the solubility parameters δ1 and δ2.

1. Relationship Between the Heating Temperatures T1 and T2 and the Solubility Parameters δ1 and δ2

EXPERIMENTAL EXAMPLES 1-1 TO 1-48

Through the following procedure, the image forming developers and the bonding developer were manufactured.

[Manufacturing of the Image Forming Developers]

First, prepared as raw materials were styrene, acrylic acid, and methylmetacrylic acid. Subsequently, by copolymerizing the raw materials using the emulsion polymerization method, styrene-acrylic copolymers (primary particles) that are the image forming macromolecular compounds were obtained. Subsequently, the image forming pigments that are coloring agents, the image forming macromolecular compounds (styrene-acrylic copolymers), and wax (stearyl stearate) were mixed and aggregated to obtain the base developers.

The types of the image forming pigments are as follows. In order to manufacture the yellow image forming developer, PY (Pigment Yellow)—74 was used. In order to manufacture the magenta image forming developer, PR (Pigment Red)—122 was used. In order to manufacture the cyan image forming developer, for example, PB (Pigment Blue)—15:3 was used. In order to manufacture the black image forming developer, carbon black was used.

Lastly, using a Henschel mixer (manufactured by Mitsui Mining Co., Ltd.), mixing 100 wt. parts of the base developer, 1.5 wt. parts of an external additive, and 0.3 wt. parts of a conductive agent (titanium oxide) were mixed, and afterwards the mixture was sorted using a sieve, thereby the yellow image forming developer, the magenta image forming developer, the cyan image forming developer, and the black image forming developer were obtained. Used as the external additive was a mixture of 1 wt. part of hydrophobic silica fine powder (R-972 manufactured by Nippon Aerosil Co., Ltd.) and 1.5 wt. parts of hydrophobic silica fine powder (RY-50 manufactured by Nippon Aerosil Co., Ltd.).

In the normal temperature environment (temperature=23° C., humidity=55%), the solubility parameter δ1 of the yellow image forming developer was 16.4, the solubility parameter δ1 of the magenta image forming developer was 16.5, the solubility parameter δ1 of the cyan image forming developer was 16.8, and the solubility parameter δ1 of the black image forming developer was 16.2.

[Manufacturing of the Bonding Developer]

Using the pulverization method, the bonding developer was manufactured. In this case, first, using a Henschel mixer (manufactured by Nippon Coke & Engineering Co. Ltd.), 100 wt. parts of the bonding macromolecular compound (polyester, number average molecular weight=3700, glass transition temperature=62° C.), 1 wt. part of a charge control agent (salicylate complex), and 10 wt. parts of a release agent (glass transition temperature=100° C.) were mixed and stirred. Subsequently, after heating and melt-kneading (heating temperature=100° C., kneading time=3 hours) the mixture using an open roller type continuous kneader (KNEADEX manufactured by Nippon Coke & Engineering Co. Ltd.), the mixture was cooled down to the room temperature. Subsequently, using an impact plate mill (Dispersion Separator manufactured by Nippon Pneumatic Mfg. Co., Ltd.) utilizing a jet stream, the mixture was pulverized. Subsequently, by classifying the pulverized product using a wind rotor rotating dry pneumatic classifier (Micron Separator manufactured by Hosokawa Micron Corporation) utilizing a centrifugal force, the base developer was obtained. Lastly, using the base developer, by performing mixing and sorting in the same manner as in manufacturing the image forming developers, the bonding developer was obtained. In the normal temperature environment (temperature=23° C., humidity=55%), the solubility parameter δ2 of the bonding developer was 10.1.

Note that for comparison the bonding developer was obtained through the same procedure as in manufacturing the image forming developers except not using the image forming pigments. In the normal temperature environment (temperature=23° C., humidity=55%), the solubility parameter δ2 of the bonding developer was 16.1.

[Manufacturing of the Image Structure]

First, after setting 400 g of the image forming developers (100 g for each color) and 100 g of the bonding developer mentioned above in the image forming apparatus (the image forming development parts 40 and the bonding development part 50), the image forming apparatus was left alone overnight (for 12 hours or more) in the normal temperature environment (temperature=23° C., humidity=55%).

Subsequently, using the image forming apparatus, the image information F and the bonding layer H were formed on both faces of the medium M. As the medium M, white plain paper (Excellent White PPR-CA4NA manufactured by Oki Data Corporation, size=A4, basis weight=80 g/m$^2$) was used.

In this case, using the image forming developers, the image forming developer images (image information F) were formed on the front face (faces A1, A2, and A3) and the back face (faces B1, B2, and B3) of the medium M. Afterwards, using the bonding developer, the bonding developer image (bonding layer H) was formed on part of the front face (faces A2 and A3) and part of the back face (faces B1 and B2) of the medium M where the image information F is formed.

Note that in order to facilitate evaluating (judging) image migration mentioned below, as the image information F, images including multiple characters (sentences) (yellow character images, magenta character images, cyan character images, and black character images) are formed, and the bonding layer H was formed so as to cover the entire image information F (multiple characters).

Lastly, after the medium M on which the image information F and the bonding layer H were formed was folded in a Z shape, the medium M was bonded by thermal compression using the image forming apparatus (fuser part 60). Thereby, the medium M was bonded using the bonding layer H so as to have the image information F concealed, thus completing the image structure S.

In this case, as shown in Tables 1-4, conditions (fusing conditions) in performing the fusing process were set. Specifically, an applied pressure R (kg/cm$^2$) and the heating temperature T1 (° C.) in performing the fusing process using the image forming developers were set, and also the applied pressure P (kg/cm$^2$) and the heating temperature T2 (° C.) in performing the fusing process using the bonding developer were set. The solubility parameter δ1 ((cal/cm$^3$)$^{1/2}$) of the image forming developers, the solubility parameter δ2 ((cal/cm$^3$)$^{1/2}$) of the bonding developer, the difference (T1−T2) between the heating temperatures T1 and T2, and the absolute value of the difference (|δ1−δ2|) between the solubility parameters δ1 and δ2 in each of the individual fusing conditions are as shown in Tables 1-4. Note that concerning the colors of the image forming developers, "Y" indicates yellow, "M" magenta, "C" cyan, and "K" black.

[Quality Evaluation of the Image Structure]

When the quality of the image structure S was examined in relation to the heating temperatures T1 and T2 and the solubility parameters δ1 and δ2, the results shown in Tables 1-4 were obtained. In examining the quality of this image structure S, after examining image migration and adhesiveness, the quality of the image structure S was comprehensively evaluated (shown as "Total" in Tables).

In examining the image migration, by manually opening (peeling off) the image structure S, it was visually checked whether any image migration had occurred. In this case, by peeling off the faces B1 and B2 from the long side edge, it was checked whether the image information F formed on the face B1 (or the face B2) had migrated to the face B2 (or the face B1). Also, by peeling off the faces A2 and A3 from the long side edge, it was checked whether the image information F formed on the face A2 (or the face A3) had migrated to the face A3 (or the face A2). As the result, the case where no image migration had occurred was judged as "good", and the case where an image migration had occurred as "no good".

In examining the adhesiveness, after opening (peeling off) the image structure S by 5 mm from the long side edge, the bond strength of the medium M was measured using a bond strength tester (Digital Force Gauge ZP-100N manufactured by Imada Co., Ltd.). In this case, after fixing the image structure S onto a supporting platform and also attaching a clip to the peeling part of the image structure S mentioned above, by peeling off the faces A2 and A3 and the faces B1 and B2 while lifting the clip vertically upwards, the strength required for the peeling (bond strength) was measured. As the result, judged as "good" was the case where the image structure S could be opened without damaging (such as tearing) the medium M because the adhesive force was 1.8 $kgf/m^2$ or larger and 1.9 $kgf/m^2$ or smaller. On the other hand, judged as "no good" was the case where the image structure S fundamentally could not be opened or the case where the medium M was damaged although the image structure S could be opened because the adhesive force was smaller than 1.8 $kgf/m^2$ or larger than 1.9 $kgf/m^2$.

In comprehensively evaluating the quality of the image structure S, the case where both the image migration evaluation result and the adhesiveness evaluation result were good was judged as "good", and the case one or both of the image migration evaluation result and the adhesiveness evaluation result were no good was judged as "no good".

TABLE 1

| | Fusing Conditions | | | | Properties | | | | | | Evaluation | | |
|---|---|---|---|---|---|---|---|---|---|---|---|---|---|
| | Image Forming Developers | | Bonding Developers | | Image Forming Developers | | Bonding Developers Forming | | | | | | |
| Examp. | R | T1 | P | T2 | Color | δ1 | Method | δ2 | T1 − T2 | \|δ1 − δ2\| | Image Migration | Adhesiveness | Total |
| 1-1 | 2.5 | 190 | 2.5 | 140 | Y | 14 | Emulsion | 14 | 50 | 0 | NG | NG | NG |
| 1-2 | | | | 150 | | 13.8 | Polymerization | 13.9 | 40 | 0.1 | NG | NG | NG |
| 1-3 | | | | 160 | | 13.6 | Method | 13.7 | 30 | 0.2 | NG | NG | NG |
| 1-4 | | | | 170 | | 13.5 | | 13.6 | 20 | 0.1 | NG | NG | NG |
| 1-5 | | | | 180 | | 13 | | 13.6 | 10 | 0.5 | NG | NG | NG |
| 1-6 | | | | 190 | | 12.6 | | 13.2 | 0 | 0.6 | NG | NG | NG |
| 1-7 | 2.5 | 190 | 2.5 | 140 | Y | 14 | Pulverization | 8.3 | 50 | 5.7 | NG | NG | NG |
| 1-8 | | | | 150 | | 13.8 | Method | 8 | 40 | 5.8 | NG | NG | NG |
| 1-9 | | | | 160 | | 13.5 | | 7.5 | 30 | 6 | Good | Good | Good |
| 1-10 | | | | 170 | | 13.5 | | 6.4 | 20 | 7.1 | Good | Good | Good |
| 1-11 | | | | 180 | | 13 | | 5.7 | 10 | 7.3 | Good | Good | Good |
| 1-12 | | | | 190 | | 12.6 | | 5.1 | 0 | 7.5 | Good | NG | NG |

Note

R.P.: Applied Pressure ($kg/cm^2$).

T1, T2: Heating Temp. (° C.).

δ1, δ2: Solubility Parameters ($((cal/cm^3)^{1/2})$)

TABLE 2

| | Fusing Conditions | | | | Properties | | | | | | Evaluation | | |
|---|---|---|---|---|---|---|---|---|---|---|---|---|---|
| | Image Forming Developers | | Bonding Developers | | Image Forming Developers | | Bonding Developers | | | | | | |
| Examp. | R | T1 | P | T2 | Color | δ1 | Forming Method | δ2 | T1 − T2 | \|δ1 − δ2\| | Image Migration | Adhesiveness | Total |
| 1-13 | 2.5 | 190 | 2.5 | 140 | M | 13.9 | Emulsion | 14 | 50 | 0.1 | NG | NG | NG |
| 1-14 | | | | 150 | | 13.7 | Polymerization | 13.9 | 40 | 0.2 | NG | NG | NG |
| 1-15 | | | | 160 | | 13.5 | Method | 13.7 | 30 | 0.2 | NG | NG | NG |
| 1-16 | | | | 170 | | 13.6 | | 13.6 | 20 | 0 | NG | NG | NG |
| 1-17 | | | | 180 | | 13 | | 13.5 | 10 | 0.5 | NG | NG | NG |
| 1-18 | | | | 190 | | 12.8 | | 13.2 | 0 | 0.4 | NG | NG | NG |
| 1-19 | 2.5 | 190 | 2.5 | 140 | M | 13.9 | Pulverization | 8.3 | 50 | 5.5 | NG | NG | NG |
| 1-20 | | | | 150 | | 13.7 | Method | 8 | 40 | 5.7 | Good | NG | NG |
| 1-21 | | | | 160 | | 13.5 | | 7.5 | 30 | 6 | Good | Good | Good |
| 1-22 | | | | 170 | | 13.6 | | 6.4 | 20 | 7.2 | Good | Good | Good |

TABLE 2-continued

| | Fusing Conditions | | | | Properties | | | | | | Evaluation | | |
|---|---|---|---|---|---|---|---|---|---|---|---|---|---|
| | Image Forming Developers | | Bonding Developers | | Image Forming Developers | | Bonding Developers | | | | Image | | |
| Examp. | R | T1 | P | T2 | Color | δ1 | Forming Method | δ2 | T1 − T2 | \|δ1 − δ2\| | Migration | Adhesiveness | Total |
| 1-23 | | | | 180 | | 13 | | 5.7 | 10 | 7.3 | Good | Good | Good |
| 1-24 | | | | 190 | | 12.8 | | 5.1 | 0 | 7.7 | Good | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 3

| | Fusing Conditions | | | | Properties | | | | | | | | |
|---|---|---|---|---|---|---|---|---|---|---|---|---|---|
| | Image Forming Developers | | Bonding Developers | | Image Forming Developers | | Bonding Developers | | | | Image | | |
| Examp. | R | T1 | P | T2 | Color | δ1 | Forming Method | δ2 | T1 − T2 | \|δ1 − δ2\| | Migration | Adhesiveness | Total |
| 1-25 | 2.5 | 190 | 2.5 | 140 | C | 14.2 | Emulsion | 14 | 50 | 0.2 | NG | NG | NG |
| 1-26 | | | | 150 | | 14 | Polymerization | 13.9 | 40 | 0.1 | NG | NG | NG |
| 1-27 | | | | 160 | | 13.6 | Method | 13.7 | 30 | 0.1 | NG | NG | NG |
| 1-28 | | | | 170 | | 13.6 | | 13.6 | 20 | 0 | NG | NG | NG |
| 1-29 | | | | 180 | | 12.9 | | 13.5 | 10 | 0.6 | NG | NG | NG |
| 1-30 | | | | 190 | | 12.7 | | 13.2 | 0 | 0.5 | NG | NG | NG |
| 1-31 | 2.5 | 190 | 2.5 | 140 | C | 14.2 | Pulverization | 8.3 | 50 | 5.9 | Good | NG | NG |
| 1-32 | | | | 150 | | 14 | Method | 8 | 40 | 6 | Good | NG | NG |
| 1-33 | | | | 160 | | 13.6 | | 7.5 | 30 | 6.1 | Good | Good | Good |
| 1-34 | | | | 170 | | 13.6 | | 6.4 | 20 | 7.2 | Good | Good | Good |
| 1-35 | | | | 180 | | 12.9 | | 5.7 | 10 | 7.2 | Good | Good | Good |
| 1-36 | | | | 190 | | 12.7 | | 5.1 | 0 | 7.6 | Good | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 4

| | Fusing Conditions | | | | Properties | | | | | | Evaluation | | |
|---|---|---|---|---|---|---|---|---|---|---|---|---|---|
| | Image Forming Developers | | Bonding Developers | | Image Forming Developers | | Bonding Developers | | | | Image | | |
| Examp. | R | T1 | P | T2 | Color | δ1 | Forming Method | δ2 | T1 − T2 | \|δ1 − δ2\| | Migration | Adhesiveness | Total |
| 1-37 | 2.5 | 190 | 2.5 | 140 | K | 14.1 | Emulsion | 14 | 50 | 0.1 | NG | NG | NG |
| 1-38 | | | | 150 | | 13.9 | Polymerization | 13.9 | 40 | 0 | NG | NG | NG |
| 1-39 | | | | 160 | | 13.4 | Method | 13.7 | 30 | 0.3 | NG | NG | NG |
| 1-40 | | | | 170 | | 13.4 | | 13.6 | 20 | 0.2 | NG | NG | NG |
| 1-41 | | | | 180 | | 13.1 | | 13.5 | 10 | 0.4 | NG | NG | NG |
| 1-42 | | | | 190 | | 12.9 | | 13.2 | 0 | 0.3 | NG | NG | NG |
| 1-43 | 2.5 | 190 | 2.5 | 140 | K | 14.1 | Pulverization | 8.3 | 50 | 5.8 | NG | NG | NG |
| 1-44 | | | | 150 | | 13.9 | Method | 8 | 40 | 5.9 | Good | NG | NG |
| 1-45 | | | | 160 | | 13.4 | | 7.5 | 30 | 5.9 | Good | Good | Good |
| 1-46 | | | | 170 | | 13.4 | | 6.4 | 20 | 7 | Good | Good | Good |
| 1-47 | | | | 180 | | 13.1 | | 5.7 | 10 | 7.4 | Good | Good | Good |
| 1-48 | | | | 190 | | 12.9 | | 5.1 | 0 | 7.8 | Good | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

The quality of the image structure S varied greatly according to the difference (T1−T2) between the heating temperatures T1 and T2 and the absolute value of the difference (|δ1−δ2|) between the solubility parameters δ1 and δ2.

Here, in the case where the difference (T1−T2) of the heating temperatures T1 and T2 is 10-30° C., if the absolute value of the difference (|δ1−δ2|) between the solubility parameters δ1 and δ2 is 5.9-7.4, unlike the cases where those conditions are not satisfied, no image migration occurred, and excellent adhesiveness was also obtained.

This result indicates the following.

If the difference (T1−T2) of the heating temperatures T1 and T2 satisfies a proper condition (=10-30° C.), the amount of heat supplied to the medium M is adjusted so that the bonding layer H (bonding developer) sufficiently melts without excessively remelting the image information F (image forming developers) in the manufacturing process of the image structure S (bonding process of the medium M).

Moreover, in relation to the proper condition for the difference (T1−T2) between the heating temperatures T1 and T2 mentioned above, if the absolute value of the difference (|δ1−δ2|) between the solubility parameters δ1 and δ2 also satisfies a proper condition (=5.9-7.4), the relationship between the thermal properties of the image forming developers and the thermal properties of the bonding developer is adjusted so that the image forming developers and the bonding developer are not mixed (compatible) at the time of remelting in the manufacturing process of the image structure S mentioned above.

Therefore, if both the difference (T1−T2) between the heating temperatures T1 and T2 and the absolute value of the difference (|δ1−δ2|) between the solubility parameters δ1 and δ2 satisfy proper conditions, both suppressing the image migration and securing the adhesiveness can be achieved.

2. Relationship Between the Applied Pressure P and the Solubility Parameters δ1 and δ2

EXPERIMENTAL EXAMPLES 2-1 THROUGH 2-168

As shown in Tables 5-16, by changing the applied pressures R and P and the heating temperatures T1 and T2, through the same procedure as in Experimental Examples 1-1 through 1-48 except changing the solubility parameters δ1 and δ2 and the absolute value of their difference (|δ1−δ2|), the image forming developers, the bonding developer, and the image structure S were manufactured, and the quality of the image structure S was examined in relation to the applied pressure P and the solubility parameters δ1 and δ2.

TABLE 5

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-1 | 2.5 | 190 | 1 | 160 | Y | 12.6 | Emulsion | 13.2 | 0.6 | NG | NG | NG |
| 2-2 | | | 1.5 | | | | Polymerization | 13.3 | 0.7 | NG | NG | NG |
| 2-3 | | | 2 | | | | Method | 13.5 | 0.9 | NG | NG | NG |
| 2-4 | | | 2.5 | | | | | 13.7 | 1.1 | NG | NG | NG |
| 2-5 | | | 3 | | | | | 13.9 | 1.2 | NG | NG | NG |
| 2-6 | | | 3.5 | | | | | 14 | 1.4 | NG | NG | NG |
| 2-7 | | | 4 | | | | | 14.1 | 1.5 | NG | NG | NG |
| 2-8 | 2.5 | 190 | 1 | 160 | Y | 12.6 | Pulverization | 5.4 | 7.2 | Good | NG | NG |
| 2-9 | | | 1.5 | | | | Method | 5.4 | 7.2 | Good | Good | Good |
| 2-10 | | | 2 | | | | | 5.8 | 6.8 | Good | Good | Good |
| 2-11 | | | 2.5 | | | | | 6.8 | 5.8 | Good | Good | Good |
| 2-12 | | | 3 | | | | | 6.8 | 5.8 | Good | Good | Good |
| 2-13 | | | 3.5 | | | | | 6.8 | 5.8 | Good | Good | Good |
| 2-14 | | | 4 | | | | | 6.9 | 5.7 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 6

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-15 | 2.5 | 190 | 1 | 170 | Y | 12.6 | Emulsion | 13.1 | 0.6 | NG | NG | NG |
| 2-16 | | | 1.5 | | | | Polymerization | 13.4 | 0.8 | NG | NG | NG |
| 2-17 | | | 2 | | | | Method | 13.5 | 0.9 | NG | NG | NG |
| 2-18 | | | 2.5 | | | | | 13.6 | 1 | NG | NG | NG |
| 2-19 | | | 3 | | | | | 13.8 | 1.2 | NG | NG | NG |

TABLE 6-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | | | |
| Examp. | R | T1 | P | T2 | Color | δ1 | Forming Method | δ2 | \|δ1 − δ2\| | Image Migration | Adhesiveness | Total |
| 2-20 | | | 3.5 | | | | | 14.1 | 1.5 | NG | NG | NG |
| 2-21 | | | 4 | | | | | 14.2 | 1.7 | NG | NG | NG |
| 2-22 | 2.5 | 190 | 1 | 170 | Y | 12.6 | Pulverization | 5.3 | 7.3 | Good | NG | NG |
| 2-23 | | | 1.5 | | | | Method | 6.4 | 7.2 | Good | Good | Good |
| 2-24 | | | 2 | | | | | 6.7 | 6.9 | Good | Good | Good |
| 2-25 | | | 2.5 | | | | | 6.4 | 6.2 | Good | Good | Good |
| 2-26 | | | 3 | | | | | 6.5 | 6.1 | Good | Good | Good |
| 2-27 | | | 3.5 | | | | | 6.8 | 5.8 | Good | Good | Good |
| 2-28 | | | 4 | | | | | 7.3 | 5.3 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 7

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | | | |
| Examp. | R | T1 | P | T2 | Color | δ1 | Forming Method | δ1 | \|δ1 − δ2\| | Image Migration | Adhesiveness | Total |
| 2-29 | 2.5 | 190 | 1 | 180 | Y | 12.6 | Emulsion | 12.8 | 0.2 | NG | NG | NG |
| 2-30 | | | 1.5 | | | | Polymerization | 13.1 | 0.5 | NG | NG | NG |
| 2-31 | | | 2 | | | | Method | 13.3 | 0.7 | NG | NG | NG |
| 2-32 | | | 2.5 | | | | | 13.5 | 0.9 | NG | NG | NG |
| 2-33 | | | 3 | | | | | 13.7 | 1.1 | NG | NG | NG |
| 2-34 | | | 3.5 | | | | | 14 | 1.4 | NG | NG | NG |
| 2-35 | | | 4 | | | | | 14.2 | 1.6 | NG | NG | NG |
| 2-36 | 2.5 | 190 | 1 | 180 | Y | 12.6 | Pulverization | 5.2 | 7.4 | Good | NG | NG |
| 2-37 | | | 1.5 | | | | Method | 5.4 | 7.2 | Good | Good | Good |
| 2-38 | | | 2 | | | | | 5.6 | 7 | Good | Good | Good |
| 2-39 | | | 2.5 | | | | | 5.7 | 6.9 | Good | Good | Good |
| 2-40 | | | 3 | | | | | 5.9 | 6.7 | Good | Good | Good |
| 2-41 | | | 3.5 | | | | | 6.8 | 5.8 | Good | Good | Good |
| 2-42 | | | 4 | | | | | 7 | 5.6 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 8

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | | | |
| Examp. | R | T1 | P | T2 | Color | δ1 | Forming Method | δ2 | \|δ1 − δ2\| | Image Migration | Adhesiveness | Total |
| 2-43 | 2.5 | 190 | 1 | 160 | M | 12.8 | Emulsion | 13.2 | 0.4 | NG | NG | NG |
| 2-44 | | | 1.5 | | | | Polymerization | 13.3 | 0.5 | NG | NG | NG |
| 2-45 | | | 2 | | | | Method | 13.5 | 0.7 | NG | NG | NG |
| 2-46 | | | 2.5 | | | | | 13.7 | 0.9 | NG | NG | NG |
| 2-47 | | | 3 | | | | | 13.9 | 1.1 | NG | NG | NG |
| 2-48 | | | 3.5 | | | | | 14 | 1.2 | NG | NG | NG |
| 2-49 | | | 4 | | | | | 14.1 | 1.3 | NG | NG | NG |

TABLE 8-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-50 | 2.5 | 190 | 1 | 160 | M | 12.8 | Pulverization Method | 5.4 | 7.4 | Good | NG | NG |
| 2-51 | | | 1.5 | | | | | 5.4 | 7.4 | Good | Good | Good |
| 2-52 | | | 2 | | | | | 6.8 | 7 | Good | Good | Good |
| 2-53 | | | 2.5 | | | | | 6.8 | 6 | Good | Good | Good |
| 2-54 | | | 3 | | | | | 6.8 | 6 | Good | Good | Good |
| 2-55 | | | 3.5 | | | | | 6.8 | 6 | Good | Good | Good |
| 2-56 | | | 4 | | | | | 6.9 | 6.9 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 9

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-57 | 2.5 | 190 | 1 | 170 | M | 12.8 | Emulsion Polymerization Method | 13.1 | 0.3 | NG | NG | NG |
| 2-58 | | | 1.5 | | | | | 13.4 | 0.6 | NG | NG | NG |
| 2-59 | | | 2 | | | | | 13.5 | 0.7 | NG | NG | NG |
| 2-60 | | | 2.5 | | | | | 13.6 | 0.8 | NG | NG | NG |
| 2-61 | | | 3 | | | | | 13.8 | 1 | NG | NG | NG |
| 2-62 | | | 3.5 | | | | | 14.1 | 1.3 | NG | NG | NG |
| 2-63 | | | 4 | | | | | 14.3 | 1.6 | NG | NG | NG |
| 2-64 | 2.5 | 190 | 1 | 170 | M | 12.8 | Pulverization Method | 5.3 | 7.6 | Good | NG | NG |
| 2-65 | | | 1.5 | | | | | 5.4 | 7.4 | Good | Good | Good |
| 2-66 | | | 2 | | | | | 5.7 | 7.1 | Good | Good | Good |
| 2-67 | | | 2.5 | | | | | 6.4 | 6.4 | Good | Good | Good |
| 2-68 | | | 3 | | | | | 6.6 | 6.3 | Good | Good | Good |
| 2-69 | | | 3.5 | | | | | 6.8 | 6 | Good | Good | Good |
| 2-70 | | | 4 | | | | | 7.3 | 5.5 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 10

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp | R | T1 | P | T2 | Color | δ1 | Forming Method | δ2 | \|δ1 − δ2\| | Migration | Adhesiveness | Total |
| 2-71 | 2.5 | 190 | 1 | 180 | M | 12.8 | Emulsion Polymerization Method | 12.8 | 0 | NG | NG | NG |
| 2-72 | | | 1.5 | | | | | 13.1 | 0.3 | NG | NG | NG |
| 2-73 | | | 2 | | | | | 13.3 | 0.5 | NG | NG | NG |
| 2-74 | | | 2.5 | | | | | 13.5 | 0.7 | NG | NG | NG |
| 2-75 | | | 3 | | | | | 13.7 | 0.9 | NG | NG | NG |
| 2-76 | | | 3.5 | | | | | 14 | 1.2 | NG | NG | NG |
| 2-77 | | | 4 | | | | | 14.2 | 1.4 | NG | NG | NG |
| 2-78 | 2.5 | 190 | 1 | 180 | M | 12.8 | Pulverization Method | 5.2 | 7.6 | Good | NG | NG |
| 2-79 | | | 1.5 | | | | | 5.4 | 7.4 | Good | Good | Good |
| 2-80 | | | 2 | | | | | 5.6 | 7.2 | Good | Good | Good |

TABLE 10-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp | R | T1 | P | T2 | Color | δ1 | Forming Method | δ2 | \|δ1 − δ2\| | Migration | Adhesiveness | Total |
| 2-81 | | | 2.5 | | | | | 5.7 | 7.1 | Good | Good | Good |
| 2-82 | | | 3 | | | | | 5.9 | 6.9 | Good | Good | Good |
| 2-83 | | | 3.5 | | | | | 6.8 | 6 | Good | Good | Good |
| 2-84 | | | 4 | | | | | 7 | 8.8 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 11

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp | R | T1 | P | T2 | Color | δ1 | Forming Method | δ2 | \|δ1 − δ2\| | Migration | Adhesiveness | Total |
| 2-85 | 2.5 | 190 | 1 | 160 | C | 12.7 | Emulsion | 13.2 | 0.5 | NG | NG | NG |
| 2-86 | | | 1.5 | | | | Polymerization | 13.3 | 0.6 | NG | NG | NG |
| 2-87 | | | 2 | | | | Method | 13.6 | 0.8 | NG | NG | NG |
| 2-88 | | | 2.5 | | | | | 13.7 | 1 | NG | NG | NG |
| 2-89 | | | 3 | | | | | 13.9 | 1.2 | NG | NG | NG |
| 2-90 | | | 3.5 | | | | | 14 | 1.3 | NG | NG | NG |
| 2-91 | | | 4 | | | | | 14.1 | 1.4 | NG | NG | NG |
| 2-92 | 2.5 | 190 | 1 | 160 | C | 12.7 | Pulverization | 5.4 | 7.3 | Good | NG | NG |
| 2-93 | | | 1.5 | | | | Method | 6.4 | 7.3 | Good | Good | Good |
| 2-94 | | | 2 | | | | | 6.8 | 6.9 | Good | Good | Good |
| 2-95 | | | 2.5 | | | | | 6.8 | 5.9 | Good | Good | Good |
| 2-96 | | | 3 | | | | | 6.8 | 5.9 | Good | Good | Good |
| 2-97 | | | 3.5 | | | | | 6.9 | 5.9 | Good | Good | Good |
| 2-98 | | | 4 | | | | | 6.9 | 5.8 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 12

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-99 | 2.5 | 190 | 1 | 170 | C | 12.7 | Emulsion | 13.1 | 0.4 | NG | NG | NG |
| 2-100 | | | 1.5 | | | | Polymerization | 13.4 | 0.7 | NG | NG | NG |
| 2-101 | | | 2 | | | | Method | 13.5 | 0.8 | NG | NG | NG |
| 2-102 | | | 2.5 | | | | | 13.6 | 0.9 | NG | NG | NG |
| 2-103 | | | 3 | | | | | 13.8 | 1.1 | NG | NG | NG |
| 2-104 | | | 3.5 | | | | | 14.1 | 1.4 | NG | NG | NG |
| 2-105 | | | 4 | | | | | 14.2 | 1.6 | NG | NG | NG |
| 2-106 | 2.5 | 190 | 1 | 170 | C | 12.7 | Pulverization | 5.3 | 7.4 | Good | NG | NG |
| 2-107 | | | 1.5 | | | | Method | 5.4 | 7.3 | Good | Good | Good |
| 2-108 | | | 2 | | | | | 5.7 | 7 | Good | Good | Good |
| 2-109 | | | 2.5 | | | | | 6.4 | 6.2 | Good | Good | Good |
| 2-110 | | | 3 | | | | | 6.5 | 6.2 | Good | Good | Good |

TABLE 12-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-111 | | | 3.5 | | | | | 6.8 | 5.9 | Good | Good | Good |
| 2-112 | | | 4 | | | | | 7.3 | 5.4 | NG | NG | NG |

Note

R, P: Applied Pressure (kg/cm$^2$),

T1, T2: Heating Temp. (° C.),

δ1, δ2: Solubility Parameters ((cal/cm$^3$)$^{1/2}$)

TABLE 13

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-113 | 2.5 | 190 | 1 | 180 | C | 12.7 | Emulsion | 12.8 | 0.1 | NG | NG | NG |
| 2-114 | | | 1.5 | | | | Polymerization | 13.1 | 0.4 | NG | NG | NG |
| 2-115 | | | 2 | | | | Method | 13.3 | 0.6 | NG | NG | NG |
| 2-116 | | | 2.5 | | | | | 13.5 | 0.8 | NG | NG | NG |
| 2-117 | | | 3 | | | | | 13.7 | 1 | NG | NG | NG |
| 2-118 | | | 3.5 | | | | | 14 | 1.3 | NG | NG | NG |
| 2-119 | | | 4 | | | | | 14.2 | 1.5 | NG | NG | NG |
| 2-120 | 2.5 | 190 | 1 | 180 | C | 12.7 | Pulverization | 5.2 | 7.5 | Good | NG | NG |
| 2-121 | | | 1.5 | | | | Method | 5.4 | 7.3 | Good | Good | Good |
| 2-122 | | | 2 | | | | | 5.6 | 7.1 | Good | Good | Good |
| 2-123 | | | 2.5 | | | | | 5.7 | 7 | Good | Good | Good |
| 2-124 | | | 3 | | | | | 5.9 | 6.8 | Good | Good | Good |
| 2-125 | | | 3.5 | | | | | 6.8 | 6.9 | Good | Good | Good |
| 2-126 | | | 4 | | | | | 7 | 5.7 | NG | NG | NG |

Note

R, P: Applied Pressure (kg/cm$^2$),

T1, T2: Heating Temp. (° C.),

δ1, δ2: Solubility Parameters ((cal/cm$^3$)$^{1/2}$)

TABLE 14

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp | R | T1 | P | T2 | Color | δ1 | Forming Method | δ2 | \|δ1 − δ2\| | Migration | Adhesiveness | Total |
| 2-127 | 2.5 | 190 | 1 | 160 | K | 12.9 | Emulsion | 13.2 | 0.3 | NG | NG | NG |
| 2-128 | | | 1.5 | | | | Polymerization | 13.3 | 0.4 | NG | NG | NG |
| 2-129 | | | 2 | | | | Method | 13.5 | 0.6 | NG | NG | NG |
| 2-130 | | | 2.5 | | | | | 13.7 | 0.8 | NG | NG | NG |
| 2-131 | | | 3 | | | | | 13.9 | 1 | NG | NG | NG |
| 2-132 | | | 3.5 | | | | | 14 | 1.1 | NG | NG | NG |
| 2-133 | | | 4 | | | | | 14.1 | 1.2 | NG | NG | NG |
| 2-134 | 2.5 | 190 | 1 | 160 | K | 12.9 | Pulverization | 5.4 | 7.5 | Good | NG | NG |
| 2-135 | | | 1.5 | | | | Method | 6.4 | 7.6 | Good | Good | Good |
| 2-136 | | | 2 | | | | | 5.8 | 7.1 | Good | Good | Good |
| 2-137 | | | 2.5 | | | | | 6.8 | 6.1 | Good | Good | Good |

TABLE 14-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp | R | T1 | P | T2 | Color | δ1 | Forming Method | δ2 | \|δ1 − δ2\| | Migration | Adhesiveness | Total |
| 2-138 | | | 3 | | | | | 6.8 | 6.1 | Good | Good | Good |
| 2-139 | | | 3.5 | | | | | 6.8 | 6.1 | Good | Good | Good |
| 2-140 | | | 4 | | | | | 6.9 | 6 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 15

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-141 | 2.5 | 190 | 1 | 170 | K | 12.9 | Emulsion | 13.1 | 0.2 | NG | NG | NG |
| 2-142 | | | 1.5 | | | | Polymerization | 13.4 | 0.5 | NG | NG | NG |
| 2-143 | | | 2 | | | | Method | 13.5 | 0.6 | NG | NG | NG |
| 2-144 | | | 2.5 | | | | | 13.6 | 0.7 | NG | NG | NG |
| 2-145 | | | 3 | | | | | 13.8 | 0.9 | NG | NG | NG |
| 2-146 | | | 3.5 | | | | | 14.1 | 1.2 | NG | NG | NG |
| 2-147 | | | 4 | | | | | 14.3 | 1.4 | NG | NG | NG |
| 2-148 | 2.5 | 190 | 1 | 170 | K | 12.9 | Pulverization | 6.3 | 7.5 | Good | NG | NG |
| 2-149 | | | 1.5 | | | | Method | 5.4 | 7.6 | Good | Good | Good |
| 2-150 | | | 2 | | | | | 5.7 | 7.2 | Good | Good | Good |
| 2-151 | | | 2.5 | | | | | 6.4 | 6.5 | Good | Good | Good |
| 2-152 | | | 3 | | | | | 6.5 | 6.4 | Good | Good | Good |
| 2-153 | | | 3.5 | | | | | 6.8 | 6.1 | Good | Good | Good |
| 2-154 | | | 4 | | | | | 7.3 | 5.6 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

TABLE 16

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-155 | 2.5 | 190 | 1 | 180 | K | 12.9 | Emulsion | 12.8 | 0.1 | NG | NG | NG |
| 2-156 | | | 1.5 | | | | Polymerization | 13.1 | 0.2 | NG | NG | NG |
| 2-157 | | | 2 | | | | Method | 13.3 | 0.4 | NG | NG | NG |
| 2-158 | | | 2.5 | | | | | 13.5 | 0.6 | NG | NG | NG |
| 2-159 | | | 3 | | | | | 13.7 | 0.8 | NG | NG | NG |
| 2-160 | | | 3.5 | | | | | 14 | 1.1 | NG | NG | NG |
| 2-161 | | | 4 | | | | | 14.2 | 1.3 | NG | NG | NG |
| 2-162 | 2.5 | 190 | 1 | 180 | K | 12.9 | Pulverization | 5.2 | 7.7 | Good | NG | NG |
| 2-163 | | | 1.5 | | | | Method | 5.4 | 7.5 | Good | Good | Good |
| 2-164 | | | 2 | | | | | 6.6 | 7.3 | Good | Good | Good |

TABLE 16-continued

| | Fusing Conditions | | | | Properties | | | | | Evaluation | | |
|---|---|---|---|---|---|---|---|---|---|---|---|---|
| | Image Forming Developers | | Bonding Developers | | Image Forming Developers | | Bonding Developers | | | Image | | |
| Examp. | R | T1 | P | T2 | Color | δ1 | Forming Method | δ2 | \|δ1 − δ2\| | Migration | Adhesiveness | Total |
| 2-165 | | | 2.5 | | | | | 5.7 | 7.2 | Good | Good | Good |
| 2-166 | | | 3 | | | | | 5.9 | 7 | Good | Good | Good |
| 2-167 | | | 3.5 | | | | | 6.8 | 6.1 | Good | Good | Good |
| 2-168 | | | 4 | | | | | 7 | 6.9 | NG | NG | NG |

Note
R, P: Applied Pressure (kg/cm$^2$),
T1, T2: Heating Temp. (° C.),
δ1, δ2: Solubility Parameters ((cal/cm$^3$)$^{1/2}$)

The quality of the image structure S varied greatly according to the applied pressure P and the absolute value of the difference (|δ1−δ2|) between the solubility parameters δ1 and δ2.

Here, in the case where the applied pressure P is 1.5 km/cm$^2$ or higher and 3.5 kg/cm$^2$ or lower, if the absolute value of the difference (|δ1−δ2|) between the solubility parameters δ1 and δ2 is 5.8 or larger and 7.5 or smaller, unlike the cases where those conditions are not satisfied, no image migration occurred, and excellent adhesiveness was obtained.

This result indicates the following.

If the applied pressure P satisfies a proper condition (=1.5-3.5 kg/cm$^2$), the pressure supplied to the medium M is adjusted so that the bonding layers H (bonding developer) make a sufficiently close contact with each other without excessively pressing each other in the manufacturing process of the image structure S (bonding process of the medium M).

Moreover, in relation to the proper condition for the applied pressure P mentioned above, if the absolute value of the difference (|δ1−δ2|) between the solubility parameters δ1 and δ2 also satisfies a proper condition (=5.8-7.5), the relationship between the thermal properties of the image forming developers and the thermal properties of the bonding developer is adjusted so that the image forming developers and the bonding developer are not mixed (compatible) at the time of remelting in the manufacturing process of the image structure S mentioned above.

Therefore, if both the applied pressure P and the absolute value of the difference (|δ1−δ2|) between the solubility parameters δ1 and δ2 satisfy proper conditions, both suppressing the image migration and securing the adhesiveness can be achieved.

Based on the results shown in Tables 1-16, if each of the difference (T1−T2) between the heating temperatures T1 and T2 and the absolute value of the difference (|δ1−δ2|) between the solubility parameters δ1 and δ2 satisfies a proper condition, or if each of the applied pressure P and the absolute value of the difference (|δ1−δ2|) between the solubility parameters δ1 and δ2 satisfies a proper condition, both suppressing the image migration and securing the adhesiveness could be achieved. Therefore, the quality of the image structure S could be improved.

In the above, although this invention was explained citing an embodiment, this invention is not limited to the mode explained in the one embodiment mentioned above, various types of modifications are possible.

For example, the image forming system of the image forming apparatus of this invention is not limited to the intermediate transfer system using an intermediate transfer belt, other image forming systems may be adopted.

What is claimed is:

1. An image forming apparatus for forming an image developer image on a medium that is carried along a medium carrying route, comprising:

at least a first development part that is provided with an image forming developer containing image forming pigments and image forming macromolecular compound, supplying the image forming developer;

at least a second development part that is provided with a bonding developer containing bonding macromolecular compound, supplying the bonding developer;

a transfer part that transfers the image forming developer supplied from the first development part to a surface of a medium, and also transfers the bonding developer supplied from the second development part to the surface of the medium to which the image forming developer was transferred, and a fuser part that is positioned at a downstream side of the medium carrying route from the transfer part and fuses the image forming developer to the medium by heating the image forming developers transferred by the transfer part, and also fuses the bonding developer with the medium by heating the bonding developer transferred by the transfer part to the surface of the medium where the image forming developer is fused, wherein heating temperature T1 (° C.) for the image forming developer by the fuser part and heating temperature T2 (° C.) for the bonding developer by the fuser part satisfy a condition expressed by Eq. (1) below, and solubility parameter δ1 of the image forming macromolecular compound and solubility parameter δ2 of the bonding macromolecular compound satisfy a condition expressed by Eq. (2) below.

$$10^\circ\ \text{C.} \le T1 - T2 \le 30^\circ\ \text{C.} \quad (1)$$

$$5.9 \le |\delta 1 - \delta 2| \le 7.4. \quad (2)$$

2. The image forming apparatus according to claim 1, wherein the medium is to be folded so that two surfaces facing each other are formed from the surface on which the bonding developer was supplied, the fuser part bonds the two surfaces of the medium through the bonding developer by heating the medium where the image forming developer and the bonding developer were fused.

3. The image forming apparatus according to claim 1, wherein the medium is to be folded so that two surfaces facing each other are formed from the surface on which the bonding developer was supplied, the image forming apparatus further comprises a bonding part that bonds the medium, where the image forming developers were fused, through the bonding developer by heating the medium where the image forming developers and the bonding developer were fused by the fuser part.

4. The image forming apparatus according to claim 1, further comprising:

another first development part that is in the same structure as the first development part and containing another image forming pigment that is different from that of the first development part, wherein the image forming pigment and the another image forming pigment are selected from a yellow pigment, a magenta pigment, a cyan pigment, and a black pigment, and the bonding developer does not contain any of the image forming pigments for the first development part.

5. The image forming apparatus according to claim 1, wherein a type of the image forming macromolecular compound is different from a type of the bonding macromolecular compound.

6. An image forming apparatus for forming an image developer image on a medium that is carried along a medium carrying route, comprising:

at least a first development part that is provided with an image forming developer containing image forming pigments and image forming macromolecular compound, supplying the image forming developer;

at least a second development part that is provided with a bonding developer containing bonding macromolecular compound, supplying the bonding developer;

a transfer part that transfers the image forming developer supplied from the first development part to a surface of a medium, and also transfers the bonding developer supplied from the second development part to the surface of the medium to which the image forming developer was transferred, and a fuser part that is positioned at a downstream side of the medium carrying route from the transfer part and fuses the image forming developer to the medium by heating the image forming developers transferred by the transfer part, and also fuses the bonding developer with the medium by heating the bonding developer transferred by the transfer part to the surface of the medium where the image forming developer is fused, wherein applied pressure P (kg/cm$^2$) for the bonding developer by the fuser part satisfies a condition expressed by Eq. (3) below, and solubility parameter δ1 of the image forming macromolecular compound and solubility parameter δ2 of the bonding macromolecular compound satisfy a condition expressed by Eq. (4) below $$1.5\ \text{kg/cm}^2 \leq P \leq 3.5\ \text{kg/cm}^2 \quad (3)$$

$$5.8 \leq |\delta 1 - \delta 2| \leq 7.5. \quad (4)$$

7. The image forming apparatus according to claim 6, wherein the medium is to be folded so that two surfaces facing each other are formed from the surface on which the bonding developer was supplied, the fuser part bonds the two surfaces of the medium through the bonding developer by heating the medium where the image forming developer and the bonding developer were fused.

8. The image forming apparatus according to claim 6, wherein the medium is to be folded so that two surfaces facing each other are formed from the surface on which the bonding developer was supplied, the image forming apparatus further comprises a bonding part that bonds the medium, where the image forming developers were fused, through the bonding developer by heating the medium where the image forming developers and the bonding developer were fused by the fuser part.

9. The image forming apparatus according to claim 6, further comprising:

another first development part that is in the same structure as the first development part and containing another image forming pigment that is different from that of the first development part, wherein the image forming pigment and the another image forming pigment are selected from a yellow pigment, a magenta pigment, a cyan pigment, and a black pigment, and the bonding developer does not contain any of the image forming pigments for the first development part.

10. The image forming apparatus according to claim 6, wherein a type of the image forming macromolecular compound is different from a type of the bonding macromolecular compound.

* * * * *